US005655688A

United States Patent [19]

Moore

[11] Patent Number: 5,655,688

[45] Date of Patent: Aug. 12, 1997

[54] ATOMIZING PUMP WITH HIGH STROKE SPEED ENHANCEMENT AND VALVE SYSTEM THEREFOR

[75] Inventor: David G. Moore, Roach, Mo.

[73] Assignee: AptarGroup, Inc., Crystal Lake, Ill.

[21] Appl. No.: 430,351

[22] Filed: Apr. 28, 1995

Related U.S. Application Data

[63] Continuation-in-part of Ser. No. 412,288, Mar. 28, 1995, abandoned, which is a continuation-in-part of Ser. No. 325,800, Oct. 19, 1994, abandoned.

[51] Int. Cl.[6] ..... B67D 5/42

[52] U.S. Cl. ..... 222/321.2; 222/321.1; 222/380

[58] Field of Search ..... 222/321.1, 321.2, 222/321.7, 321.9, 380, 381, 383.1, 383.3, 385; 239/333

[56] References Cited

U.S. PATENT DOCUMENTS

| | | | |
|---|---|---|---|
| Re. 28,366 | 3/1975 | Pechstein | 239/333 |
| 1,982,497 | 11/1934 | Cotchett | 222/321.7 |
| 2,534,504 | 12/1950 | Engstrom | 222/383 |
| 2,657,834 | 11/1953 | Bacheller | 283/321 |
| 2,809,868 | 10/1957 | Thompson | 299/107.2 |
| 3,088,636 | 5/1963 | Spatz | 222/213 |
| 3,124,080 | 3/1964 | Sisson | 103/178 |
| 3,159,316 | 12/1964 | O'Donnell et al. | 222/321 |
| 3,161,329 | 12/1964 | Fedit et al. | 222/321 |
| 3,187,960 | 6/1965 | Gorman | 222/321 |
| 3,211,346 | 10/1965 | Meshberg | 222/263 |
| 3,223,292 | 12/1965 | Keeney et al. | 222/321 |
| 3,228,570 | 1/1966 | Steiman | 222/321 |
| 3,228,571 | 1/1966 | O'Donnell et al. | 222/321 |
| 3,229,864 | 1/1966 | Roder | 222/321 |
| 3,237,571 | 3/1966 | Corsette | 103/188 |
| 3,239,151 | 3/1966 | Jokelson | 239/333 |
| 3,248,022 | 4/1966 | Schulman et al. | 222/321 |
| 3,257,961 | 6/1966 | Schlenker | 103/178 |
| 3,331,559 | 7/1967 | Fedit | 239/333 |
| 3,361,305 | 1/1968 | Spatz | 222/207 |
| 3,399,836 | 9/1968 | Fechstein | 239/333 |
| 3,414,169 | 12/1968 | Corsette | 222/321 |
| 3,458,090 | 7/1969 | Scoggin, Jr. | 222/309 |
| 3,463,093 | 8/1969 | Pfeiffer et al. | 103/188 |
| 3,583,605 | 6/1971 | Corsette | 222/321 |
| 3,608,788 | 9/1971 | Tanaka | 222/384 |
| 3,627,206 | 12/1971 | Boris et al. | 239/321 |
| 3,680,790 | 8/1972 | Boris | 239/353 |
| 3,746,260 | 7/1973 | Boris | 239/321 |
| 3,756,474 | 9/1973 | Riccio | 222/193 |
| 3,759,426 | 9/1973 | Kane | 222/385 |
| 3,761,022 | 9/1973 | Kondo | 239/333 |
| 3,774,849 | 11/1973 | Boris | 239/338 |
| 3,786,963 | 1/1974 | Metzler, III | 222/136 |
| 3,796,375 | 3/1974 | Boris | 239/333 |
| 3,799,448 | 3/1974 | Nozawa et al. | 239/321 |
| 3,877,616 | 4/1975 | Stevens | 222/321 |
| 3,908,870 | 9/1975 | Nozawa et al. | 222/321 |
| 3,923,250 | 12/1975 | Boris | 239/321 |
| 3,940,028 | 2/1976 | Beard | 222/321 |
| 3,949,906 | 4/1976 | Pettersen et al. | 222/153 |
| 3,949,910 | 4/1976 | Focht | 222/321 |
| 3,990,611 | 11/1976 | Sojka | 222/135 |

(List continued on next page.)

FOREIGN PATENT DOCUMENTS

| | | | |
|---|---|---|---|
| 0 014 754 A1 | 9/1980 | European Pat. Off. | B05B 11/00 |
| 0 289 855 A3 | 11/1988 | European Pat. Off. | B05B 11/00 |
| 0 289 856 A2 | 11/1988 | European Pat. Off. | B05B 11/00 |
| 0 289 854 A2 | 11/1988 | European Pat. Off. | B05B 11/00 |
| 0 289 855 A2 | 11/1988 | European Pat. Off. | B05B 11/00 |
| 89100879.1-2309 | 8/1990 | European Pat. Off. | B05B 11/00 |
| 2.133.259 | 11/1972 | France | B05B 11/00 |
| 2.285.815 | 9/1974 | France | A23L 2/26 |
| 2.249.716 | 5/1975 | France | B05B 9/047 |
| 2.433.982 | 3/1980 | France | B05B 11/00 |
| 2.558.214 | 7/1985 | France | F04B 21/04 |
| 27 49 644 | 11/1978 | Germany | B05B 1/00 |
| 27 32 888 | 2/1979 | Germany | F04B 19/00 |
| 201989 | 10/1986 | Italy . | |
| 58-122066 | of 1983 | Japan . | |
| 93/13873 | 7/1993 | WIPO . | |

OTHER PUBLICATIONS

Seaquist Pump Systems Brochure "The SeaMist System" (2 Pages) (no date).

Seaquist Pump Systems Brochure "The Sea Spray System" (2 Pages) (1993).

Seaquist Pump Systems Brochure "The EuroMist System" (2 Pages) (1993).

"Bakan Plastics Non–Aerosol Sprayers and Dispensers" Brochure (11 Pages) (no date).

*Primary Examiner*—Andres Kashnikow
*Assistant Examiner*—Kenneth Bomberg
*Attorney, Agent, or Firm*—Dressler, Rockey, Milnamow & Katz, Lt.

[57] ABSTRACT

A discharge valve system is provided for a finger-operable pump with an actuating plunger. In one embodiment, the plunger includes a piston disposed in a pump pressurizing chamber. In another embodiment, the plunger is slidably disposed on a fixed piston so that the plunger and piston together define a pressurizing chamber. In either embodiment, the chamber receives fluid from a container. The actuating plunger defines a discharge passage establishing communication between the ambient atmosphere and the chamber. The discharge valve system includes a valve seat defined by the plunger in the discharge passage. A valve member is disposed in the discharge passage and is movable (a) upstream to a closed position against the valve seat wherein the valve member defines a first area subjected to the chamber pressure and (b) downstream to an open position away from the valve seat wherein the valve member defines a second area subjected to the chamber pressure such that the net pressure force imposed on the valve member by the chamber pressure is greater when the valve member is opened than when the valve member is closed. A spring biases the valve member toward the valve seat and another spring biases the plunger to an elevated, rest position.

17 Claims, 16 Drawing Sheets

U.S. PATENT DOCUMENTS

| | | | |
|---|---|---|---|
| 3,991,914 | 11/1976 | Kotuby et al. | 222/321 |
| 4,022,354 | 5/1977 | Kotuby | 222/321 |
| 4,025,046 | 5/1977 | Boris | 239/333 |
| 4,050,613 | 9/1977 | Corsette | 222/321 |
| 4,050,860 | 9/1977 | Beres | 417/444 |
| 4,051,983 | 10/1977 | Anderson | 222/321 |
| 4,056,216 | 11/1977 | Kotuby | 222/385 |
| 4,061,247 | 12/1977 | Meshberg | 222/341 |
| 4,089,442 | 5/1978 | Hafele et al. | 222/321 |
| 4,113,145 | 9/1978 | Meshberg | 222/1 |
| 4,144,987 | 3/1979 | Kishi | 222/321 |
| 4,147,476 | 4/1979 | Warren | 417/328 |
| 4,154,374 | 5/1979 | Kirk, Jr. | 222/321 |
| 4,169,546 | 10/1979 | Yuhas et al. | 222/341 |
| 4,189,064 | 2/1980 | O'Neill et al. | 222/321 |
| 4,230,242 | 10/1980 | Meshberg | 222/321 |
| 4,274,560 | 6/1981 | Cater | 222/321 |
| 4,323,175 | 4/1982 | Eckert | 222/256 |
| 4,369,899 | 1/1983 | Magers et al. | 222/153 |
| 4,402,432 | 9/1983 | Corsette | 222/321 |
| 4,410,107 | 10/1983 | Corsette | 222/321 |
| 4,458,832 | 7/1984 | Corsette | 222/153 |
| 4,485,943 | 12/1984 | Czech | 222/256 |
| 4,496,082 | 1/1985 | Corsette | 222/153 |
| 4,503,996 | 3/1985 | Šorm et al. . | |
| 4,533,069 | 8/1985 | Drobish | 222/209 |
| 4,606,497 | 8/1986 | Brocklin . | |
| 4,615,465 | 10/1986 | Grothoff . | |
| 4,657,161 | 4/1987 | Endo et al. | 222/256 |
| 4,735,347 | 4/1988 | Schultz et al. . | |
| 4,821,928 | 4/1989 | Su . | |
| 4,830,284 | 5/1989 | Maerte | 239/333 |
| 4,941,595 | 7/1990 | Montaner et al. | 222/321 |
| 4,986,453 | 1/1991 | Lina et al. . | |
| 5,002,207 | 3/1991 | Giuffredi | 222/340 |
| 5,011,046 | 4/1991 | Graf et al. | 222/321 |
| 5,020,696 | 6/1991 | Cater | 222/385 |
| 5,025,928 | 6/1991 | Montaner et al. | 222/321 |
| 5,038,965 | 8/1991 | Cater . | |
| 5,238,156 | 8/1993 | Andris | 222/207 |

ATOMIZING PUMP WITH HIGH STROKE SPEED ENHANCEMENT AND VALVE SYSTEM THEREFOR

CROSS-REFERENCE TO RELATED APPLICATION

This application is a continuation-in-part application of U.S. patent application Ser. No. 08/412,288, filed on Mar. 28, 1995, now abandoned, which is a continuation-in-part application of application Ser. No. 08/325,800, filed on Oct. 19, 1994 now abandoned.

TECHNICAL FIELD

This invention relates to a finger-operable pump and is particularly well-suited for incorporation in a pump which dispenses an atomized spray when the pressure within the pump reaches a predetermined value.

BACKGROUND OF THE INVENTION AND TECHNICAL PROBLEMS POSED BY THE PRIOR ART

Finger-operable liquid dispensing pumps are typically adapted to be mounted on hand-held containers. Such containers are commonly used for liquid products, such as household and automotive cleaners, industrial preparations, and personal care products such as hairsprays, deodorants, colognes, and the like. Typically, the pump is operated to produce a fine mist or atomized spray.

Finger-operable pumps conventionally employ a pump chamber in which is disposed a pressurizing piston that can be actuated by pressing down on an external actuator button or plunger. A spring acts against the piston or actuator button to return the piston and actuator button upwardly to the elevated rest position when the finger pressure is released.

Typically, a valve member is provided within the pump and is biased by a spring to close a discharge passage at a valve seat. This permits a predetermined pressure to be built up within the pump chamber as the pump actuator is pressed downwardly. When the pressure force within the pump chamber exceeds the valve member spring biasing force, the valve member opens to permit discharge of the pressurized liquid from the pump chamber.

The discharging liquid exits the pump through a nozzle as a jet stream, a coarse spray, an atomized fine spray, etc., depending upon the structure of the nozzle, operating pressures, stroke speed, and characteristics of the liquid being dispensed.

Some pump designs are especially suitable for producing an atomized fine spray of liquid. The manufacturer of the liquid may desire that it be dispensed in a substantially fully atomized spray condition so as to produce a relatively fine mist. Typically, conventional pumps designed for producing a fine mist work well only if operated in a certain manner (e.g., typically through a full, or complete, stroke at a stroke speed exceeding a predetermined minimum stroke speed).

For example, if the pump operator slows the compression stroke below a certain speed or temporarily stops the compression stroke, then the desired discharge spray is not produced. Rather, a more coarse spray may be produced than is desired.

Further, manufacturers of some liquid products may have a desired or recommended dose or quantity of product which is to be dispensed with each actuation of the pump. The quantity to be dispensed depends on the length of the pump stroke prior to release of the finger force. If the finger is released from the actuator prior to the completion of the full pump stroke, then the quantity of the discharged product will be less than is intended or desired by the manufacturer.

It would be desirable to provide an improved design which operates as intended substantially independently of the range of the typical force or movement of the operator's finger. It would also be advantageous if such an improved system produced a fine mist spray without the application of excessively high forces to the pump actuator.

It would also be desirable if such an improved system could accommodate initial priming of the pump chamber while exhausting air through the discharge orifice in an efficient manner.

Further, it would also be beneficial if the improved system could be incorporated in a pump having a minimum final volume at the end of the compression stroke so as to effect efficient priming of the system and a more rapid return of the pump actuator during the return stroke.

It would also be desirable to provide an improved design which could accommodate a relatively short stroke so as to permit a reduction in the overall pump height.

Preferably, a pump incorporating such improved design features should also perform consistently with respect to the discharge particle size and the required actuation force as well as with respect to the quantity of discharged product per full stroke actuation.

Advantageously, such improved design features should also be readily incorporated in the pump and in components therefor so as to facilitate economical manufacture, high production quality, and consistent operating parameters unit-to-unit with high reliability.

The present invention provides an improved pump valve system and pump which can accommodate designs having the above-discussed benefits and features.

SUMMARY OF THE INVENTION

The present invention provides an improved valve system for a finger-operable pump, and the present invention includes an improved pump design which can incorporate such a valve system.

The operation of a pump incorporating the improved system is substantially independent of the typical range of finger force and movement associated with pump actuation. A pump incorporating the present invention eliminates or substantially minimizes the possibility of the pump being operated through only a partial compression stroke or being operated at a relatively low stroke rate which could result in a low flow rate and an undesirably coarse spray.

When a pump incorporating the present invention is actuated, the pump provides initial, momentary resistance to the operator, and this is followed by significantly less resistance for the remaining portion of the compression stroke. The greater force that is initially required results in the operator's finger momentum carrying the finger and the pump actuator to the end of the compression stroke.

The compression stroke is sufficiently short, and the initial operating force is sufficiently high, so that the operator cannot terminate the finger force quickly enough to prevent the actuator from being driven rapidly to the end of the compression stroke. Thus, the full compression stroke volume of liquid is dispensed from the pump, and the discharge of the liquid occurs at a rate that substantially equals or exceeds a desired minimum flow rate.

According to one aspect of the present invention, a discharge valve system is provided for a finger-operable pump. The pump has an actuating plunger. In one embodiment, the plunger includes a movable pressurizing piston operatively disposed in a pump chamber that receives fluid from a container. In a preferred embodiment, the plunger is slidably disposed on a stationary piston, and the plunger and piston together define a pressurizing chamber. In either embodiment, the actuating plunger defines a discharge passage establishing communication between the ambient atmosphere and the chamber.

The discharge valve system includes a valve seat defined by the plunger in the discharge passage. A valve member is disposed in the discharge passage and is movable upstream to a closed position against the valve seat. The valve member is also movable downstream to an open position away from the valve seat.

A releasable holding means is associated with the valve member for holding the valve member in the closed position when the chamber pressure is less than a predetermined pressure. The releasable holding means permits the chamber pressure to urge the valve member to an open position with a substantially instantaneously increased net pressure force on the valve member when the chamber pressure is at least equal to the predetermined pressure.

In a preferred embodiment, the releasable holding means associated with the valve member includes first and second pressurizable areas defined by the valve member. The first area defined by the valve member is subjected to the chamber pressure upstream of the valve seat when the valve member is in the closed position. The second area defined by the valve member is subjected to the chamber pressure when the valve member is moved away from the closed position such that the net pressure force imposed on the valve member by the chamber pressure to urge the valve member away from the closed position is greater when the valve member is away from the closed position than when the valve member is at the closed position. The releasable holding means also includes a spring biasing the valve member toward the valve seat.

The preferred embodiment of the pump valve member has a relatively small, first pressurizable area (i.e., the area defined by the valve member that is subjected to the chamber pressure when the valve member is in the closed position). Wheat he valve member is moved to an open position away from the Valve seat, the second pressurizable area of the valve member exposed to the chamber pressure is much greater than the first pressurizable area. This second area in the preferred embodiment includes the first area. The second, greater area that is subjected to pressure imposes a substantially instantaneously increased net force on the valve member which drives the valve member away from the valve seat very quickly.

In the preferred embodiment, the valve member includes a sleeve which is slidably and sealingly engaged with the actuating plunger downstream of the valve seat. When the second, larger area of the valve member is subjected to the chamber pressure, a net force is imposed on the valve member which forces it to slide along the actuating plunger away from the valve seat. The valve member has only a very small amount of surface area facing away from the valve seat against which the pressure can act to urge the valve member toward the valve seat. However, the surface area facing toward the valve seat is relatively large. Thus, a relatively large net force can act on this surface to force the valve member further away from the valve seat at a relatively high rate of speed.

As the valve member moves quickly to the fully open position, communication is established between the pressure chamber and the discharge passage. Because the valve member moves very quickly to its fully open position in the discharge passage, the maximum volume of the discharge passage is substantially instantaneously placed in communication with the pressure chamber.

The pressurized liquid from the pressure chamber can then flow rapidly through the fully open valve seat and through the maximum volume of the discharge passage. Because the large surface area at one end of the open valve member is subjected to the fluid pressure, the valve member is held by the pressure at the full open position. Thus, there is a reduced resistance to liquid flow past the valve member, and this results in a relatively high discharge rate of liquid from the pressure chamber through the discharge passage. This provides the desired fine mist spray and permits the plunger to move rapidly toward the bottom of the stroke.

The operator senses that the pump seems to have initial, momentary resistance to plunger actuation which is followed by a relatively low resistance. The initial higher force supplied, by the operator causes the operator's finger to continue moving, with the initially applied high force and at a high rate of speed, against the actuator until the plunger reaches the end of the compression stroke.

The compression stroke is sufficiently short, and the initial resistance is sufficiently high, so that a typical operator cannot release (inadvertently or intentionally) the finger pressure fast enough to effect only a partial compression stroke or to effect the compression stroke at a slow rate. Further, owing to the operator's finger momentum, the stroke is fully completed, and is completed at a sufficiently high rate of speed, so as to provide at least the minimum liquid discharge flow rate that is necessary to produce the desired volume of spray and the desired degree of atomization.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the pumps embodying this invention are described in the normal (upright) operating position, and terms such as upper, lower, horizontal, etc., are used with reference to this position. It will be understood, however, that the pumps and components embodying this invention may be manufactured, stored, transported, used, and sold in an orientation other than the position described.

Figures illustrating the pumps show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
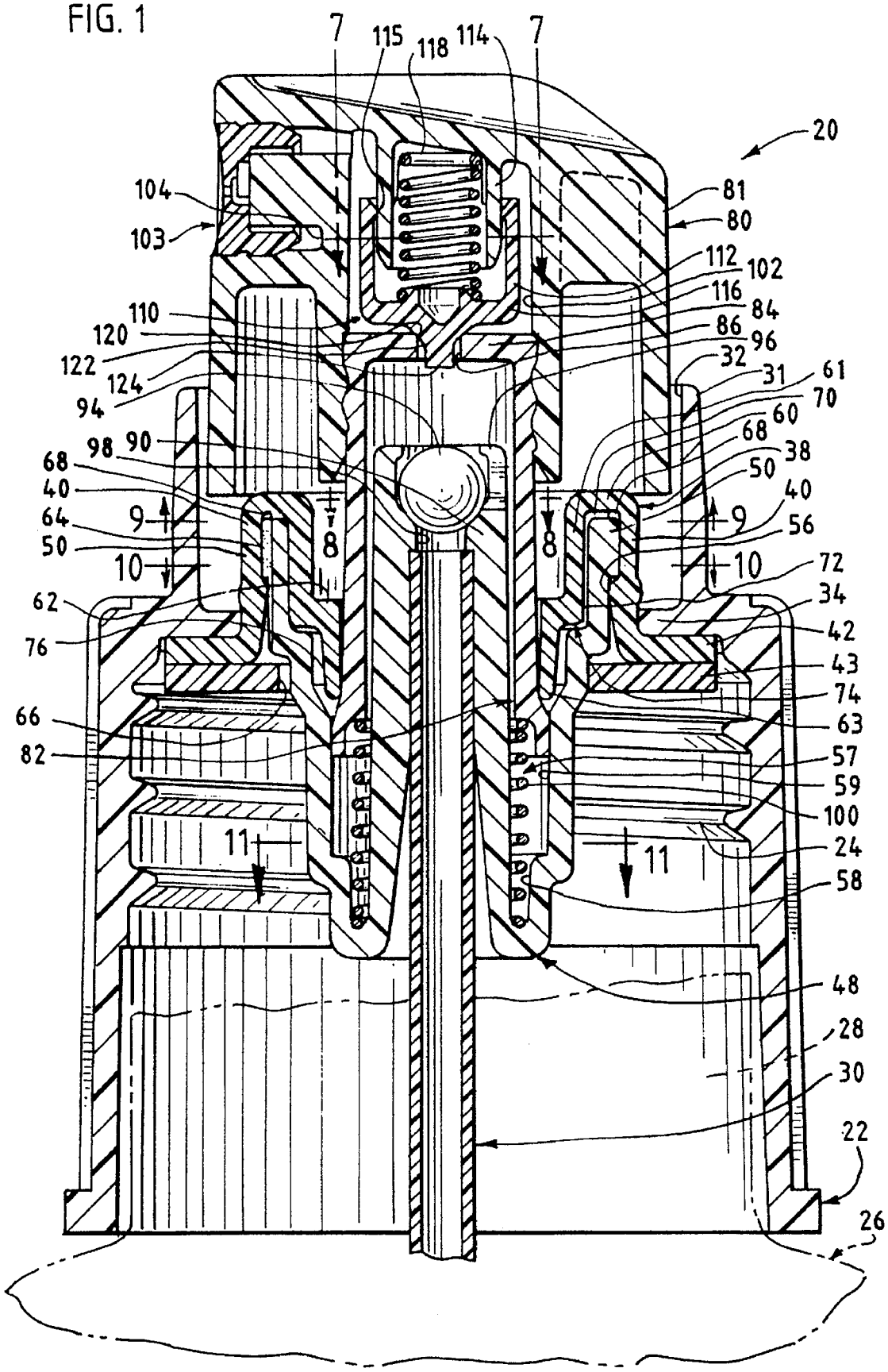
FIG. 1 is an elevational view, partly in cross section, of a first embodiment of a finger-operable pump shown with a fragmentary portion of a suction tube or dip tube and shown mounted on the top of a container that is illustrated in phantom by dashed lines.

With reference to FIG. 1, a pump embodying the present invention is designated generally by the reference numeral 20. The pump 20 is mounted within a conventional closure, cup, or cap 22 which includes suitable means, such as threads 24, for attaching the cap 22, along with the pump 20 mounted therein, to the open top of a conventional container 26.

The container 26 is adapted to hold a liquid product (not visible below the pump 20 in the container 26 illustrated in FIG. 1). Typically, the container 26 can be conveniently held in the user's hand.

The container 26 may be made of any suitable material, such as metal, glass, or plastic. The container can have a reduced diameter neck 28 defining a mouth into which the pump 20 is inserted. The container neck 28 typically has threads (not visible in FIG. 1) for engaging the pump cap threads 24.

The liquid in the container 26 is drawn up into the pump 20 through a conventional suction tube or dip tube 30 which is connected by suitable conventional means to the bottom of pump 20. The suction tube 30 extends to near the bottom of the container 26. The bottom end of the suction tube 30 is normally submerged in the liquid when the container 26 is in a generally upright orientation as illustrated in FIG. 1.

The cap 22 has a generally cylindrical, upper, hollow wall 31 defining an interior cylindrical opening 32 above, and separated from, the threads 24 by an inwardly projecting, annular flange 34.

Mounted within the opening 32 of the cap 22 is a turret 38 which has an outer wall 40 defining an outwardly projecting annular flange 42 on its lower end. An annular gasket or liner 43 is disposed beneath the turret flange 42. The turret flange 42 and liner 43 are retained by the cap flange 34 tight against the top of the mouth of the container 26.

The turret 38 is adapted to engage and retain the pump 20 within the cap or closure 22. To this end, the pump 20 includes a housing or body 48 with a thickened rim 50 at its upper end. The rim 50 is engaged by a radially inwardly projecting protuberance or bead 56 on the inner surface of the outer wall 40 of the turret 38. The turret 38 can be easily snap-fit onto the pump body 48 to effect this engagement.

The pump body 48 defines an internal pump chamber 57. In a preferred embodiment, the pump chamber includes a first, or lower, generally cylindrical portion 58 and a second, or upper, generally cylindrical portion 59 which has a larger diameter.

The upper end of the pump chamber 57 is open to receive a portion of the turret 38. The turret 38 has an annular top wall 60 extending inwardly over the top of the pump body rim 50. The turret includes an upper, inner sidewall 61 extending downwardly on the inside of the pump body rim 50. An annular shoulder 62 extends inwardly from the bottom of the upper sidewall 61. A lower, inner sidewall 63 extends downwardly from the shoulder 62.

Figure 10:
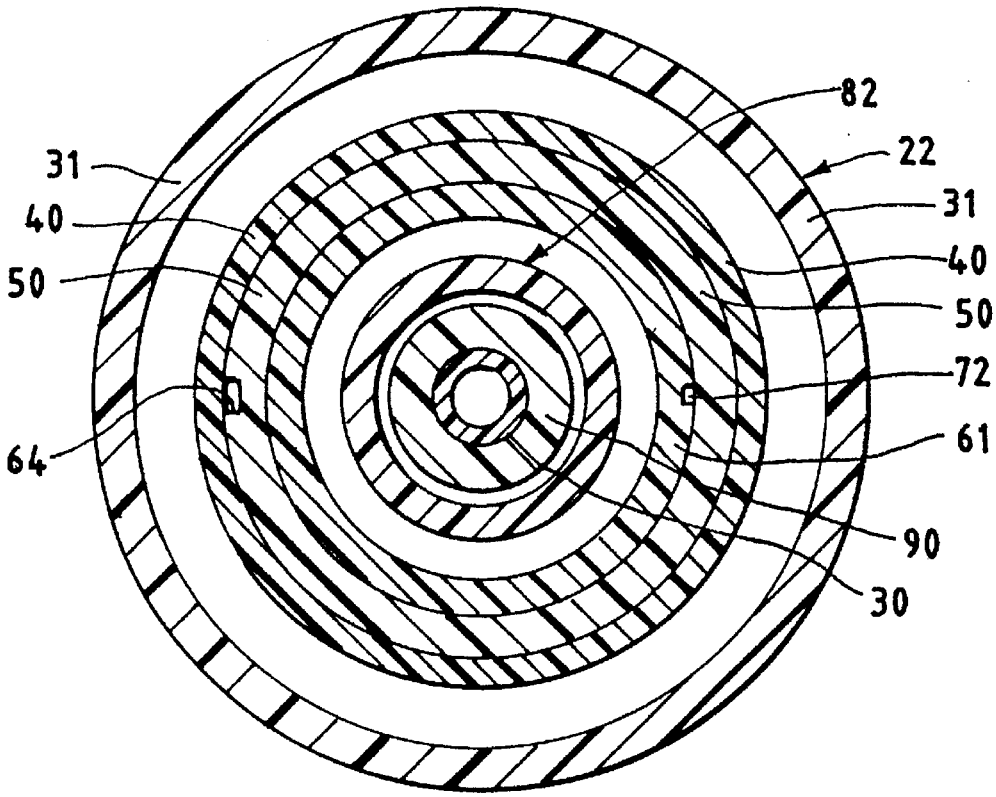
FIG. 10 is a cross-sectional view taken generally along the plane 10—10 in FIG. 1.
Figure 11:
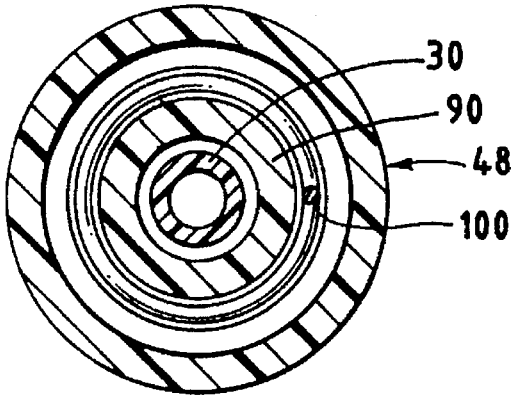
FIG. 11 is a cross-sectional view taken generally along the plane 11—11 in FIG. 1.

With reference to the left-hand side of FIG. 1 and with reference to FIG. 10, the rim 50 at the upper end of the pump body 48 defines a vertical notch 64 on the outer side of the pump body 48. This provides a air-venting gap between the pump body 48 and the turret outer sidewall 40. The bottom of the notch 64 communicates with a void above the annular liner 43 and with a notch 66 defined on the inside radius of the liner 43 adjacent the pump body 48. Thus, the vertical notch 62 is in communication with the interior of the container 26.

Figure 9:
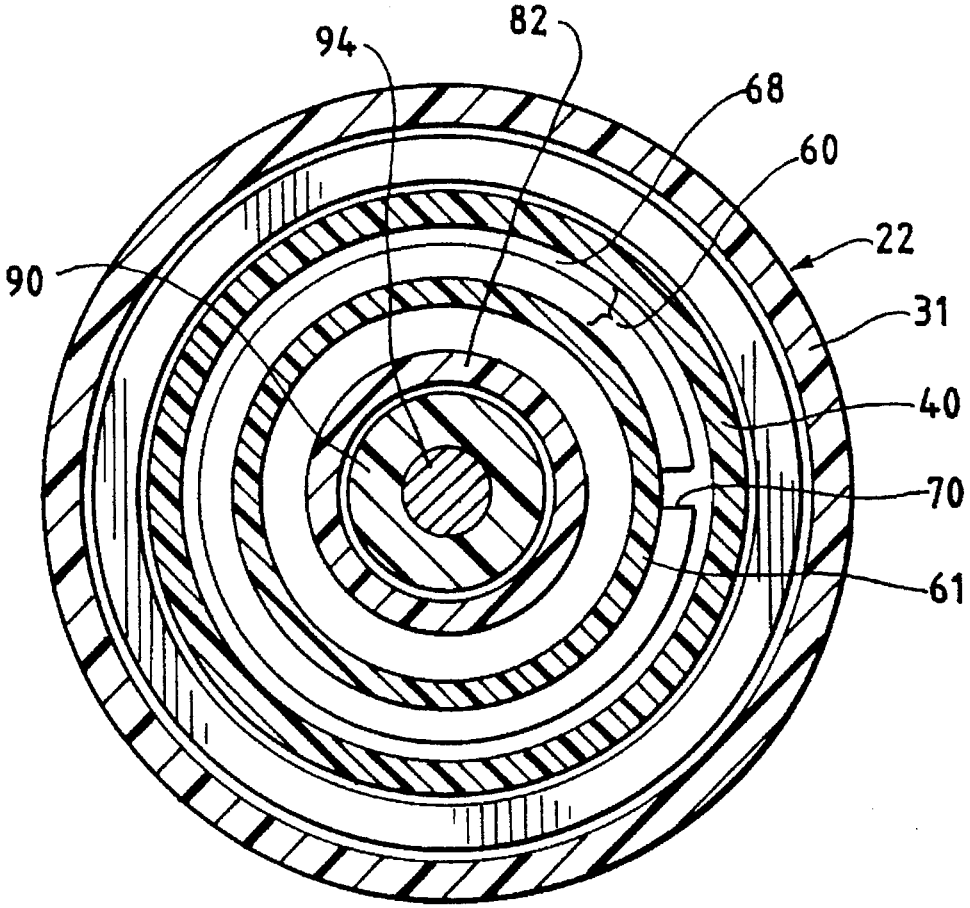
FIG. 9 is a cross-sectional view taken generally along the plane 9—9 in FIG. 1.

The vent system further includes an annular channel or circumferential groove 68 in the downwardly facing surface of the turret annular top wall 60. The vent passage system also includes a radial groove 70 extending from the annular groove 68 in the underside of the turret top wall 60 (FIG. 9). The outer surface of the turret upper, inner sidewall 61 defines a vertical channel 72 (FIG. 10) that extends to the turret shoulder 62. The downwardly facing surface of the turret shoulder 62 defines a radial channel 74 (FIG. 7) that communicates with the bottom of the vertical channel 72. The inner end of the radial channel 74 communicates with a lower vertical space 76 defined along the outer surface of the turret's lower, inner sidewall 63 (FIG. 1). Thus, a vent passage is established from the container 26 and extends up alongside of the outer surface of the pump body 48, over the top of the pump body rim 50, and then down between the pump body 48 and turret inner sidewalls 61, 62, and 63 to the bottom of the turret's inner sidewall 63.

When the pump is actuated (as explained in detail hereinafter) to a depressed position (such as any of the positions illustrated in FIGS. 2–6 for increasingly depressed positions), clearance is established adjacent the inside surface of the turret's inner sidewall 63. This brings the vent passage system into communication with outside ambient atmosphere. The vent system accommodates the flow of air into the container during the refilling of the pump chamber in a manner described in detail hereinafter.

As illustrated in FIG. 1, the pump 20 has an actuating plunger 80. The plunger 80 includes an actuating button 81 and a piston 82. The piston 82 is received within the pump chamber 57 and is slidably and sealingly engaged with the cylindrical portion 59 of the pump chamber 57.

The piston 82 is hollow and extends upwardly out of the pump body 48. The upper end of the, piston part of the plunger includes a horizontal top wall 84 defining a discharge orifice 86.

The inside of the hollow piston 82 is adapted to accommodate a conduit 90 that is unitary with, and which projects upwardly from, the bottom of the pump body 48. The conduit 90 receives the upper end of the dip tube 30 and defines at its upper end a retention cage in which is disposed a non-return ball or check valve ball 94. The upper end of the conduit 90 around the ball 94 defines a vertical slot 96. The conduit 90 also defines an opening 98 below the ball 94, and the opening 98 communicates with the upper, open end of the dip tube 30. The upper end of the pump body conduit 90 permits the ball 94 to move upwardly a small amount, in response to the force of incoming liquid flowing up the dip tube 30 (as described in detail hereinafter), so as to establish communication between the dip tube 30 and the inside of the piston 82 within the pump chamber 57. Normally, the ball 94 is held by the force of gravity to sealingly occlude the opening 98.

A main spring or return spring 100 is disposed at the bottom of the pump body 48 within the pump chamber 57 and engages the piston 82 so as to normally bias the piston 82 upwardly to an elevated, unactuated, rest position as shown in FIG. 1.

The actuating button 81 defines a discharge passage which includes the discharge orifice 86 and which extends from the discharge orifice 86 to the exterior of the button 81.

The discharge passage within the actuating button 81 includes an enlarged cavity 102 downstream of the discharge orifice 86. The discharge cavity 102 communicates with a conventional spray insert nozzle 103 through suitable passages 104. Liquid passing through the insert nozzle 103 under pressure exits the nozzle as a fine mist spray. The insert nozzle 103 may be of any suitable conventional or special design. The detailed design and operation of the insert nozzle 103 form no part of the present invention.

Figure 7:
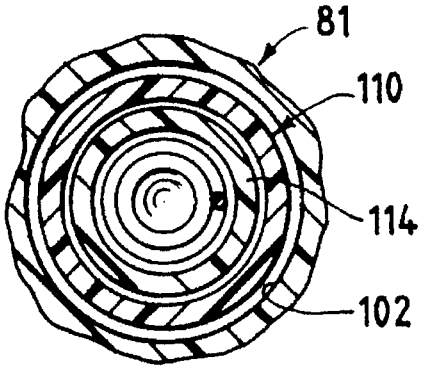
FIG. 7 is a fragmentary, cross-sectional view taken generally along the plane 7—7 in FIG. 1.
Figure 8:
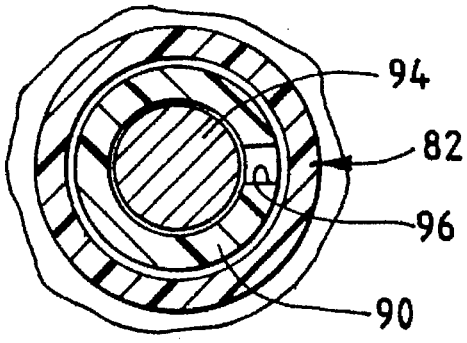
FIG. 8 is a fragmentary, cross-sectional view taken generally along the plane 8—8 in FIG. 1.

A valve member 110 is disposed within the discharge cavity 102 as illustrated in FIGS. 1 and 7. In the preferred form illustrated in FIG. 1, the valve member 110 has an annular sleeve 112 which is slidably and sealingly engaged with a hollow post 114 that projects downwardly from the top of the button 81 inside the discharge cavity 102. A bead or flange 115 is provided on the inside of the sleeve 112 to effect the seal against the post 114.

The valve member 110 includes a cross wall 116 at the bottom Of the sleeve 112. A helical compression spring 118 is disposed within the hollow post 114, and the upper end of the spring 118 bears against the top of the button 81 while the lower end of the spring 118 bears against the valve member cross wall 116 so as to bias the valve member 110 upstream toward the discharge orifice 86.

The valve member 110, in the rest position illustrated in FIG. 1, occludes the discharge orifice 86. To this end, the upper end of the piston 82 in the plunger 80 defines a valve seat 120 around the periphery of the downstream edge of the discharge orifice 86. Further, the valve member defines a frustoconical sealing surface 122 for sealingly engaging the valve seat 120.

The valve member 110 includes an engaging post 124 projecting downwardly from the frustoconical sealing surface 122. When the valve member 110 is in the fully closed position as illustrated in FIG. 1, the engaging post 124 projects through, and beyond, the discharge orifice 86.

The operation of the pump 20 will next be described with reference to FIGS. 1–6 which illustrate sequentially moved positions. The pump components initially have the positions as illustrated in FIG. 1, and it is assumed that the pump chamber 57 is filled with liquid. The process by which the pump chamber 57 initially becomes filled with liquid is described in detail hereinafter.

Figure 2:
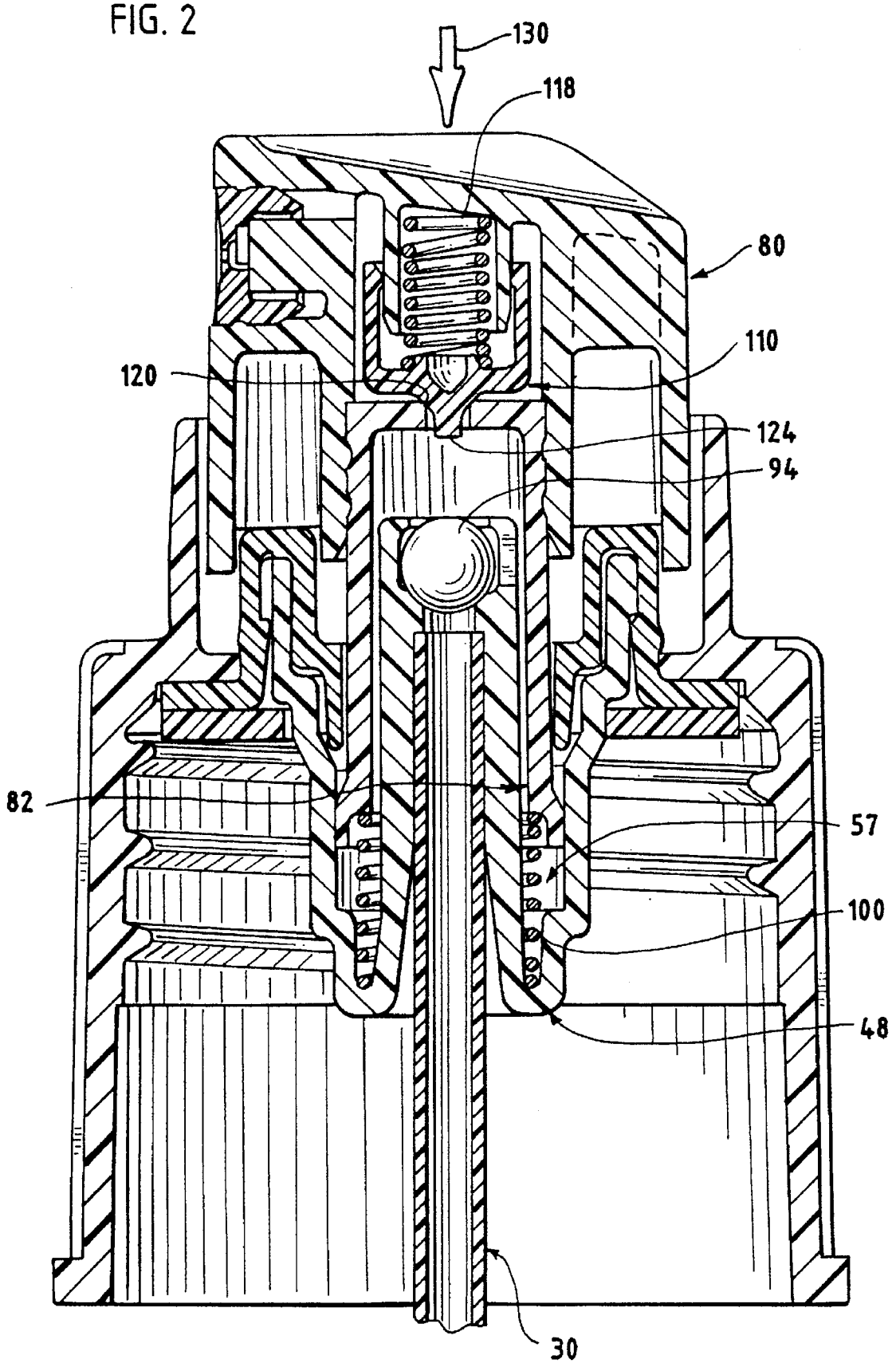
FIGS. 2–6 are views similar to FIG. 1 but show sequentially moved positions of the pump components to illustrate the sequence of the operation of the pump.

As shown in FIG. 2, an initial force is applied to the plunger 80 to move the plunger downwardly. In FIG. 2, the downward movement of the plunger 80 is schematically represented by the arrow 130. The liquid in the pump chamber 57, and any air that may be trapped therein, is compressed as the plunger piston 82 moves downwardly in the pump chamber 57. The downward movement of the piston 82 causes the return spring 100 to compress.

Figure 3:
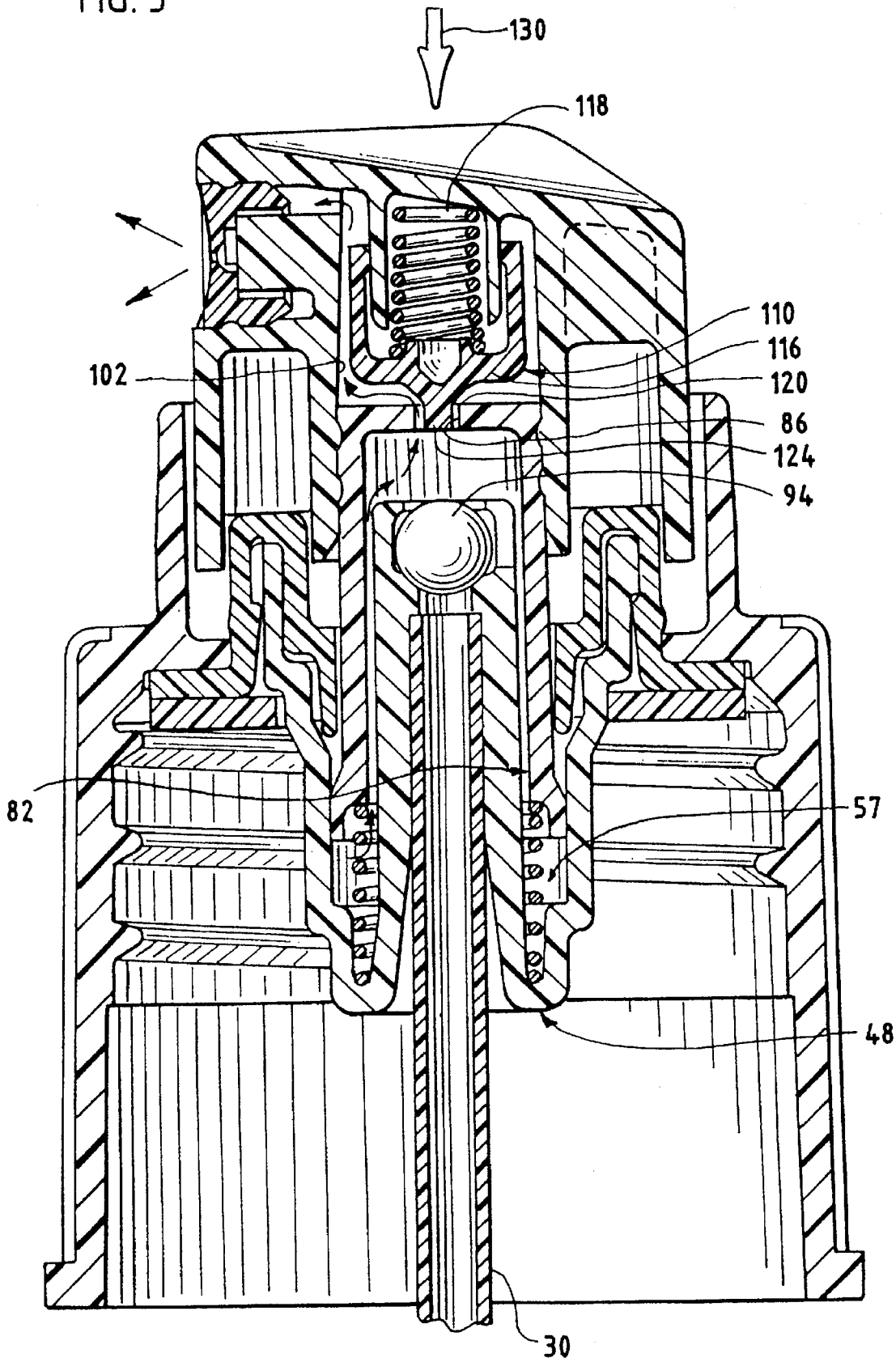

Continued downward movement of the piston 82 (as shown in FIG. 3) causes the pressure within the pump chamber 57 to build up sufficiently to force the valve member 110 upwardly away from the valve seat 120 around the discharge orifice 86 because the force of the valve spring 118 is overcome. Initially, when the valve member 110 is in the fully closed position, as illustrated in FIG. 2, only the portion of the valve member 110 that projects inwardly from the valve seat 120 is exposed to the increasing pressure in the pump chamber 57. The area of the valve member 110 exposed to the valve chamber pressure when the valve member is in the closed position may be characterized as a "first pressurizable area" or "first area," and it is a relatively small area. Accordingly, a substantial pressure must be built up within the pump chamber in order to initially move the valve member 110 against the spring 118 and upstream away from the valve seat 120. However, as soon as the valve member 110 has just lifted off of the valve seat 120 as illustrated in FIG. 3, the remaining portion of the valve member 110 is exposed to the chamber pressure as the pressurized liquid flows through the discharge orifice 86. This occurs as soon as the valve member 110 is lifted an infinitesimal amount.

The valve member 110 may be characterized as having a "second pressurizable area" which is subjected to the chamber pressure when the valve member 110 is moved away from the valve seat 120. The pressure force imposed on the valve member by the chamber pressure when the valve member is spaced away from the valve seat 120 is greater than the pressure force imposed on the valve member by the chamber pressure when the valve member is closed.

In the preferred embodiment illustrated in FIGS. 1–6, the second pressurizable area of the valve member 110 includes the first pressurizable area which is exposed to the chamber pressure when the valve member is in the closed position. Both the first pressurizable area and second pressurizable area of the valve member include multiple surfaces subjected to pressure which imposes pressure-generated forces in more than one direction. However, as the valve member 110F is lifted off of the seat 120F, the sum of the pressure-generated forces acting on the valve member in the direction to urge the valve member 110 away from the valve seat 120 exceeds the sum of the pressure-generated forces acting on the valve member to urge the valve member toward the valve seat.

Nevertheless, until a predetermined pressure is established in the valve chamber 57 by depressing the plunger 80, the net pressure-generated force acting to urge the valve member 110 open is opposed and exceeded by the biasing force of the spring 118. When the net pressure force acting to urge the valve member 110 away from the valve seat 120 exceeds the force of the spring 118, the valve member 110 begins to open. Then the second pressurizable area of the valve member 110 is subjected to a substantially instantaneously increased net pressure force acting in a direction to force the valve member 110 further away from the seat, and this instantaneously applied, increased, net pressure force drives the valve member 110 very rapidly upwardly to the full open position illustrated in FIG. 4 wherein the spring 118 is in a condition of maximum compression and the valve member cross wall 116 engages the distal end of the post 114.

Figure 4:
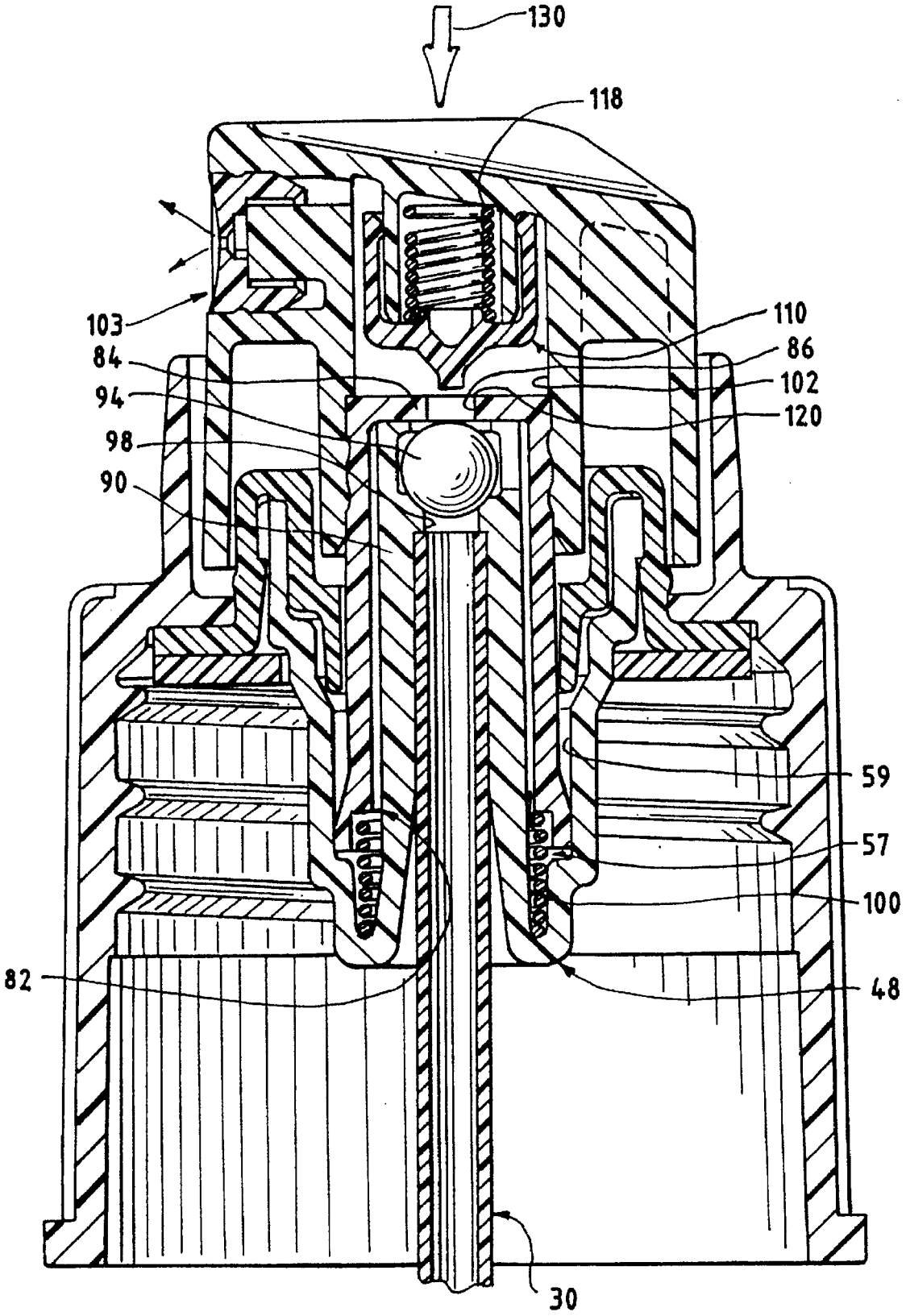

When the valve member 110 moves quickly to the fully open position as illustrated in FIG. 4, communication is established between the pressure chamber 57 and the discharge passage which includes the cavity 102. Because the valve member 110 moves quickly to its fully open position in the discharge cavity 102, the maximum volume of the discharge passage is substantially instantaneously placed in communication with the pressure chamber 57. The pressurized liquid from the pressure chamber 57 can then flow rapidly through the fully opened valve seat 120 and through the maximum volume of the discharge passage.

Because the large surface area at the upstream (lower) end of the open valve member 110 is subjected to the fluid pressure, the valve member 110 is held by the pressure at the full open position (FIG. 4). This is in contrast with certain conventional designs wherein a valve must be held away from a valve seat by the friction loss forces or velocity head forces of the fluid flowing past the valve member. The reduced resistance to liquid flow past the fully opened valve member 110 results in a relatively high discharge rate of liquid from the pressure chamber 57 through the discharge passage. This provides the desired fine mist spray and permits the chamber piston 82 to move rapidly to the bottom of the pressure chamber 57.

When the pump is actuated, the operator senses that the pump seems to have an initial, momentary resistance to plunger actuation which is followed by a relatively low resistance. The initial, higher force supplied by the operator causes the operator's finger to continue moving, with the initially applied high force and at a high rate of speed, against the actuator until the chamber piston reaches the end of the compression stroke. The compression stroke is sufficiently short, and the initial resistance is sufficiently high, so that the operator normally cannot, even if he tries, release his finger pressure fast enough to effect only a partial compression stroke or to effect the compression stroke at a slow rate. Further, owing to the operator's finger momentum, the stroke is completed at a sufficiently high rate of speed to provide at least the minimum liquid discharge flow rate that is necessary to produce the desired volume of spray and the desired degree of atomization.

The relationship among the valve member first pressurizable area, the second pressurizable area, and the associated biasing spring 118 may be characterized as a "releasable holding means" for holding the valve member in the closed position when the chamber pressure is less than the predetermined pressure and for permitting the chamber pressure to urge the valve member to an open position with a substantially instantaneously increased net pressure force on the valve member when the chamber pressure is at least equal to the predetermined pressure.

In alternate embodiments, not illustrated, other components may be incorporated as part of the releasable holding means. For example, the biasing spring 118 could be replaced with a structure designed to deform, break away, collapse, fail away, etc., after an initial, predetermined force is applied to the valve member 110. Then, the valve member 110 would move away from the valve seat so that the larger, second pressurizable surface area of the valve member 110 would be subjected to the chamber pressure. This would result in the valve member 110 being rapidly moved to the elevated, fully opened position (FIG. 4) to permit discharge of the pressurized liquid at a high rate.

Regardless of the type of releasable holding means employed, as the fluid exits from the pressure chamber 57 and sprays out of the insert nozzle 103, the piston 82 moves to the bottom of the compression stroke as illustrated in FIG. 4. The movement of the piston 82 in the downward direction may be terminated by means of any convenient stopping structure. In the preferred embodiment illustrated in FIG. 4, the piston cross wall 84 (in which the discharge orifice 86 is defined) engages the upper, distal end of the body conduit 90. At this point, the lower end of the piston 82 is at, or nearly at, the bottom of the body cylindrical portion 59, and the spring 100 is substantially fully compressed. Preferably, this results in a minimum of "dead" space or volume. Thus, there is only a very small volume remaining in the pressure chamber 57 below the piston 82 at the bottom of the compression stroke that can be occupied by residual liquid.

It will be appreciated that the non-return ball 94 is normally held by gravity in a sealing position over the opening 98 so as to prevent the compressed liquid from being forced back down into the dip tube 30. During the pressurization of the pump chamber by the piston 82, the increased pressure serves to additionally hold the ball 94 in sealing engagement over the opening 98.

Figure 5:
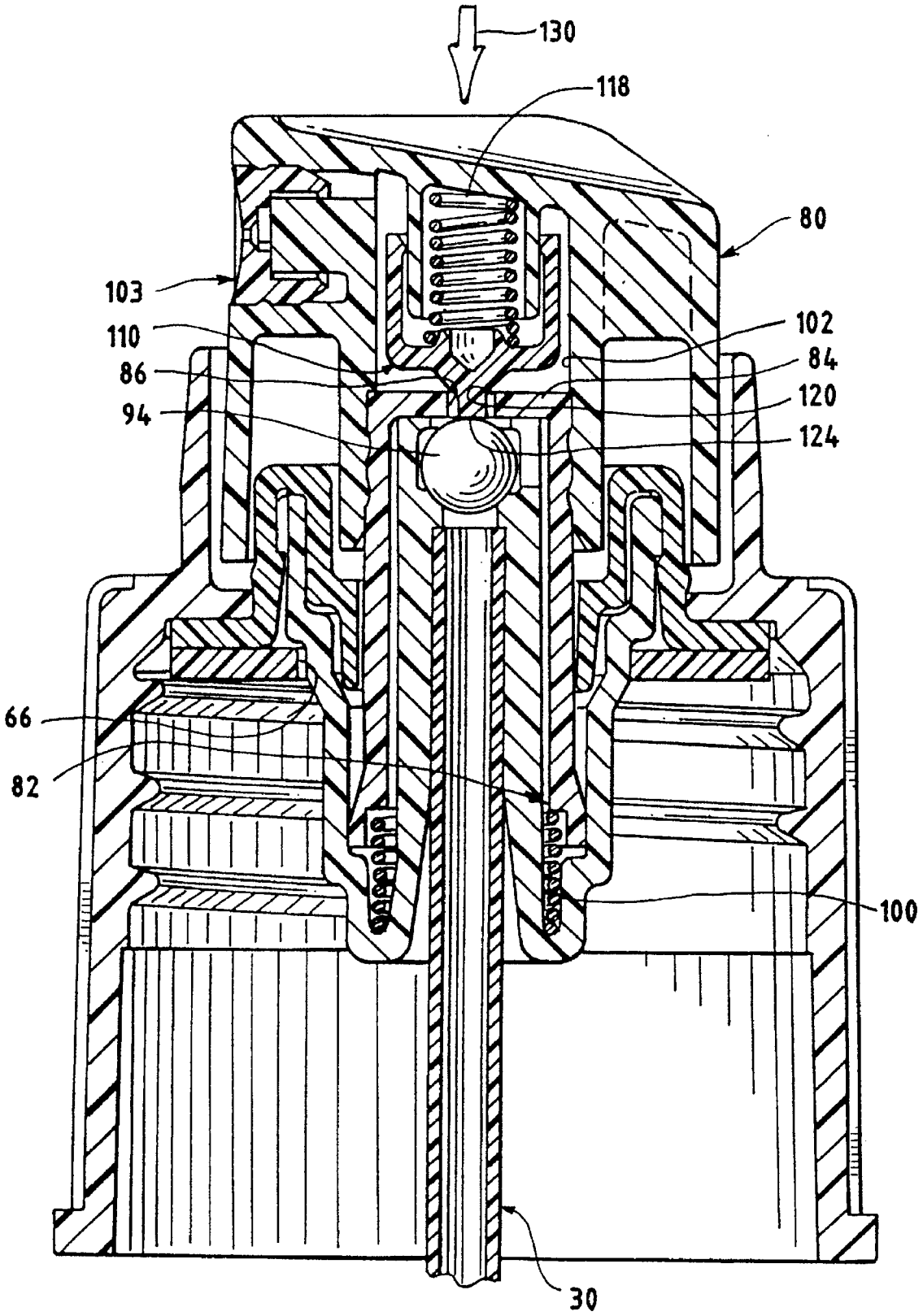

As the pressurized liquid is discharged out of the insert nozzle 103 from the pump 20, the pressure within the discharge passage, including the discharge cavity 102, decreases. The net pressure force on the valve member 110 which holds the valve member 110 away from the valve seat 120 thus decreases. When the net pressure force acting upwardly on the valve member 110 becomes less than the force of the spring 118, the valve member 110 is forced downwardly by the spring 118 toward the valve seat 120. The lower, distal end of the valve member post 124 then engages the top of the non-return ball 94. As illustrated in FIG. 5, this prevents the valve member 110 from sealingly engaging the valve seat 120 and occluding the discharge orifice 86. This feature is employed in initially priming the pump with liquid and discharging the air from within the pump chamber as described in detail hereinafter.

Figure 6:
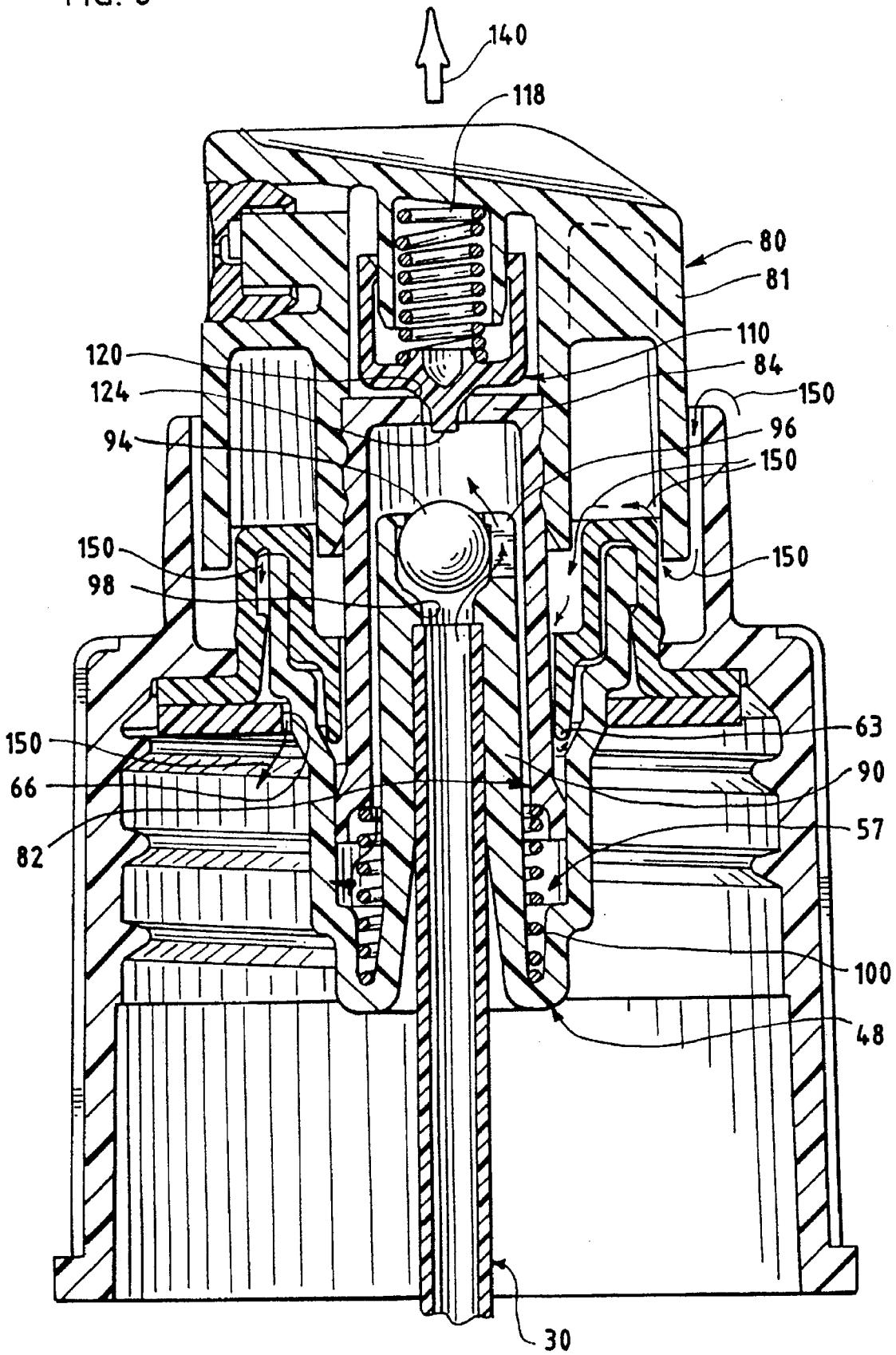

Generally, when the operator of the pump realizes that the further downward movement of the pump plunger 80 is prevented, the operator terminates the application of force through the operator's finger. The return spring 100 is then able to force the actuator plunger 80, along with the piston 82 contained therein, upwardly toward the fully elevated, rest position (FIG. 1). FIG. 6 illustrates the plunger 80 moving upwardly from the fully depressed position toward the fully elevated position, and the upward movement is schematically illustrated by the arrow 140.

As the plunger 80 moves upwardly under the influence of the return spring 110, the piston, including the piston cross wall 84, moves upwardly with the actuator button 81. This brings the valve seat 120 into engagement with the valve member 110. The valve member 110 is thus carried upwardly by the cross wall in the button 81. The valve member post 124 eventually becomes completely disengaged from the top of the non-return ball 94, and the valve member 110 remains held by the biasing spring 118 in sealing engagement against the valve seat 120.

It will be appreciated that as the plunger 80 moves upwardly with the discharge orifice 86 sealed closed by the valve member 110, the volume of the pressure chamber 57 defined within and below the hollow piston 82 increases. This results in a decrease in the internal pressure within the chamber 57.

The liquid in the container (container 26 in FIG. 1) is under atmospheric pressure. The difference between the atmospheric pressure on the liquid in the container and the reduced pressure under the piston 82 around the non-return ball 94 defines a pressure differential. This imposes a lifting force on the liquid which drives the liquid up the dip tube and lifts the ball 94. The liquid can then flow through the opening 98, through the slot 96 at the top of the pump body conduit 90, and into the pump chamber 57 within the hollow piston 82.

Atmospheric pressure is maintained on the liquid within the container 26 through the previously described venting system defined by the liner channel 66 and turret channels 64, 68, 70, 72, 74, and 76 (FIG. 1). It will be appreciated that so long as the piston 82 is below the fully elevated, rest position illustrated in FIG. 1, there is an annular clearance or space between the exterior of the piston 82 and the interior lower surface of the turret inner sidewall 63. This space accommodates the vent flow of air through the vent system into the container. In FIG. 6, the air flowing into the container through the vent channels is diagrammatically illustrated by the arrows 150.

The clearance between the depressed piston 82 and turret sidewall 63 is a result of a slight taper on the exterior of the piston 82. That is, the lower end of the piston 82 has a slightly larger diameter than the upper portion of the piston 82. Thus, when the piston 82 is in the fully elevated position as illustrated in FIG. 1, the outside Surface of the piston 82 sealingly engages the bottom of the turret inner wall 63. This prevents leakage of liquid out of the pump if the unactuated pump is inadvertently tipped over or held in a non-vertical position.

When the plunger 80 returns to the fully elevated, rest position illustrated in FIG. 1, the upward movement of the piston 82 is terminated. A mechanical engagement between the bottom of the turret inner wall 63 and the larger diameter portion of the piston 82 prevents further upward movement of the piston 82 and of the attached actuator button 81. When the upward movement of the piston 82 is terminated, further expansion of pressure chamber 57 under the piston 82 ceases. Thus, the flow of the liquid from the container 26 up the dip tube 30 into the chamber 57 terminates when the atmospheric pressure within the container is balanced by the sum Of the pressure within the chamber 57 and the static head of the liquid in the dip tube above the level of the liquid in the container 26.

When a new pump is initially assembled on a container of liquid and provided to a user, the pump chamber 57 typically contains only air. The chamber 57 must be primed with liquid from the container 26. This requires removal of much of the air in the chamber and replacement of that air with livid from the container. This can be accomplished by depressing and then releasing the actuator 80 a number of times. When the actuator 80 is fully depressed, the air in the chamber 57 is compressed. Because air is so highly compressible, the initial increase in pressure within the chamber 57 may not be sufficient to overcome the biasing force of the spring 118 which holds the valve member 110 closed. However, when the actuator 80 is fully depressed, as shown in FIG. 5, the distal end of the valve member post 124 engages the non-return ball 94, and this causes the valve member 110 to be held away from the valve seat 120. This opens the discharge orifice 86 and permits some of the slightly pressurized air to discharge through the insert nozzle 103.

When the actuator 80 is next released, it is returned to the fully elevated position by the main spring 100. This increases the volume of the chamber 57 and lowers the pressure so that liquid from the container is forced by the pressure differential part way up the dip tube 30. When priming the pump 20, the operator subjects the actuator 80 to a number of such depression and release cycles. With each cycle more air is discharged from the chamber, and more liquid flows up the dip tube and eventually into the chamber. When sufficient liquid is present in the chamber, the subsequent actuations result in a discharge of the liquid as an atomized spray.

It will be appreciated that the novel structure of the pump and valve system permits the pump to be actuated with a relatively short stroke. This makes it extremely difficult for the user to terminate a compression stroke before the piston 82 reaches the bottom of the chamber 57. The initial force required to begin to move the plunger down is sufficiently great compared with the force required when the air and/or liquid begins discharging from the nozzle so that the user cannot easily terminate or slow down the stroke before the bottom of the stroke is reached. Thus, the full stroke quantity of fluid will be discharged from the pump at a flow rate that will be sufficient to provide the desired fine mist atomization.

Because the stroke length is relatively short, the overall height of the pump can be reduced, and shorter pump components can be employed.

If desired, larger ports or dual ports may be utilized in the actuator button 81. Further, the turret 38 and closure or cap 22 may be combined as a unitary structure. Also, the liner 43 may be combined with the turret 38 as a unitary structure. In addition, the novel system of the present invention accommodates the use of insert components which can be readily fabricated and relatively easily assembled.

Figure 12:
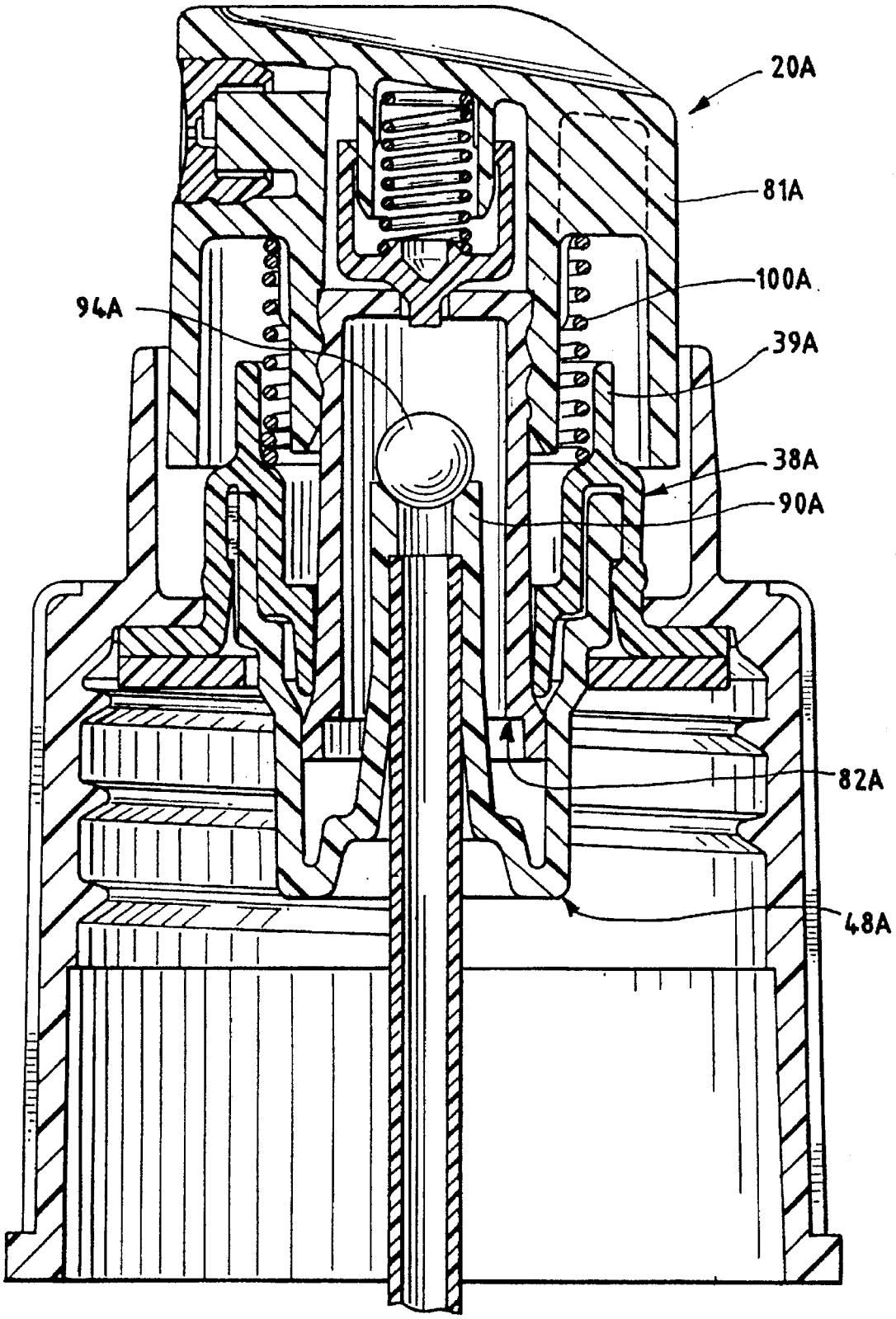
FIG. 12 is a view similar to FIG. 1, but FIG. 12 shows a second embodiment.

A second embodiment of a pump embodying the principles of the present invention is illustrated in FIG. 12. The second embodiment of the pump is designated in FIG. 12 generally by the reference number 20A. The second embodiment includes a modified pump body 48A which has an upwardly projecting, interior conduit 90A on which is disposed a non-return ball or check valve ball 94A.

Unlike the conduit 90 in the first embodiment illustrated in FIG. 1, the conduit 90A in the second embodiment does not have a retention cage structure for retaining the ball 94A in contact with the conduit. The ball 94A is free to move relatively far away from the distal end of the conduit 90A. However, the interior geometry and size of the surrounding piston 82A is such that the ball 94A will always reseat on the upper end of the conduit 90A when the pump 20A is in the upright position and when the pressure within the piston 82A is equal to, or above, the ambient atmospheric pressure.

The second embodiment oft he pump 20A also includes a modified turret 38A. The turret 38A includes an upwardly projecting, generally cylindrical retention wall 39A for containing the lower end of a return spring 100A which is disposed on the turret 38A so that the upper end of the spring 100A bears against the underside of the actuating button 81A. This arrangement, wherein the return spring is above the top of the pump body 48A, is thus different from the arrangement of the pump in the first embodiment illustrated in FIG. 1 wherein the return spring 100 is at the bottom of the pump body 48 and wherein the upper end of the return spring 100 engages the piston 82.

The remainder of the structure of the pump 20A is substantially the same as the first embodiment of the pump 20 illustrated in FIG. 1. The pump 20A operates in substantially the same manner as the pump 20.

Figure 13:
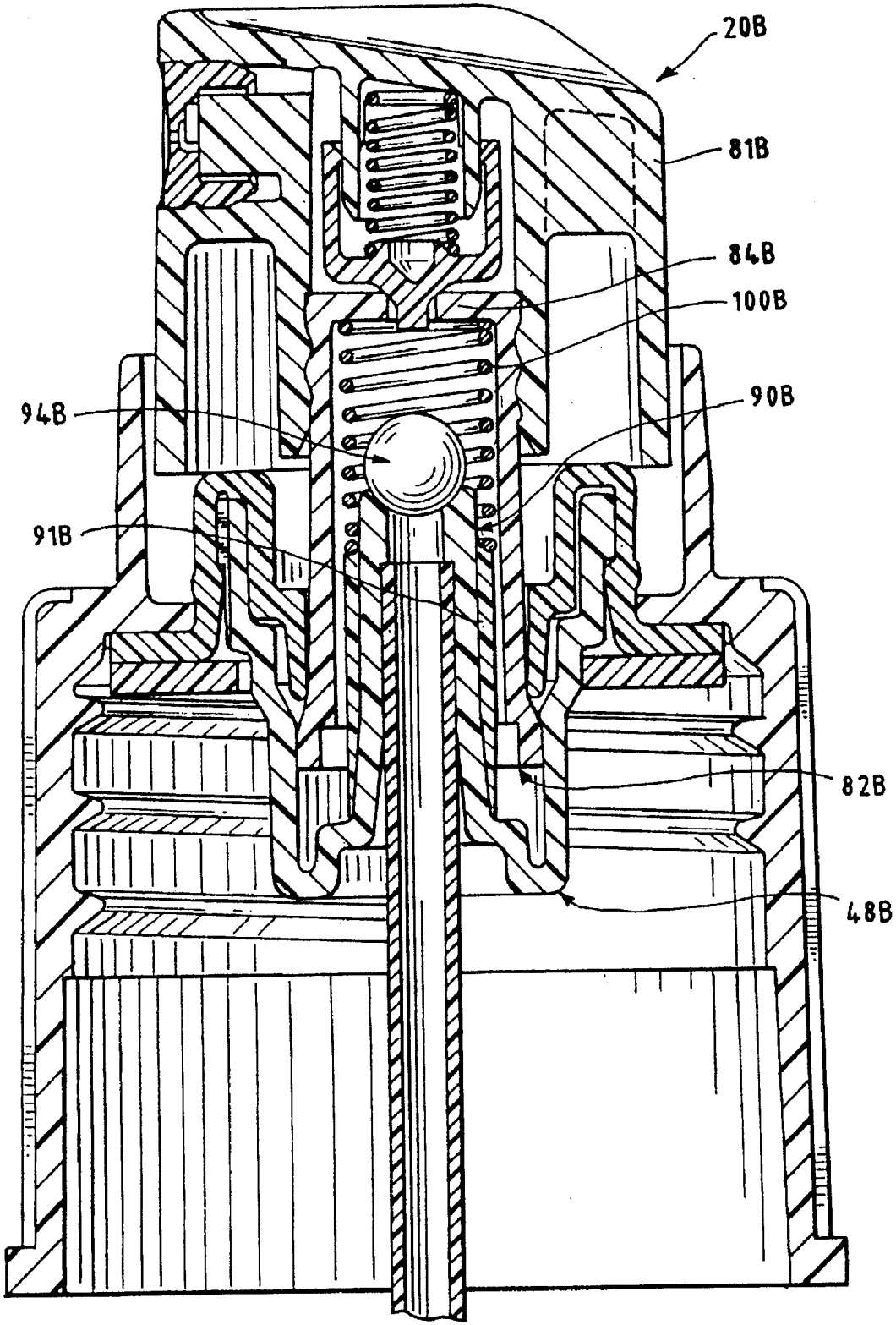
FIG. 13 is a view similar to FIG. 1, but FIG. 13 illustrates a third embodiment.

A third embodiment of a pump according to the principles of the present invention is illustrated in FIG. 13 wherein the pump is designated generally by the reference number 20B. The pump 20B is similar to the second embodiment of the pump 20A illustrated in FIG. 12 in that the pump 20B has a pump body 48B which has an upwardly projecting conduit 90B which lacks a retention cage for the check valve ball 94B. There is a difference, however, in that the conduit 90B is fitted with an external sleeve 91B. The upper end of the sleeve 91B terminates somewhat below the upper end of the conduit 90B. The upper end of the sleeve 91B supports the bottom end of a return spring 100B which is disposed within the piston 82B. The upper end of the return spring 100B bears against the underside of the piston cross wall 84B. The return spring 100B thus urges the piston 82B, and the actuator button 81B mounted thereon, to the elevated, rest position as illustrated in FIG. 13.

The remaining structure of the pump 20B is substantially the same as in the first embodiment of the pump 20 described above with reference to FIG. 1, and the pump 20B operates in substantially the same manner as the pump 20.

Figure 14:
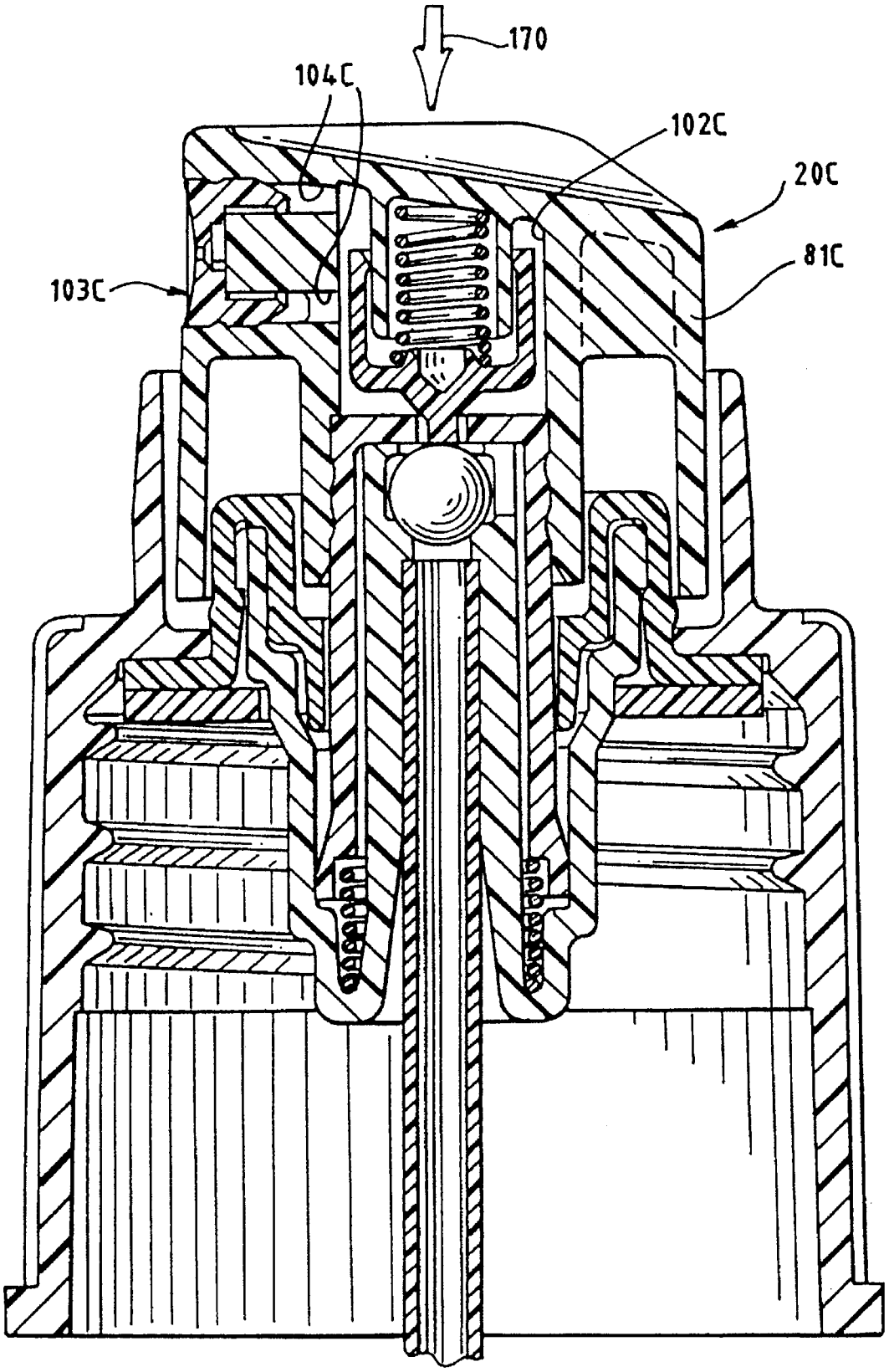
FIG. 14 is a view similar to FIG. 1, but FIG. 14 illustrates a fourth embodiment.

FIG. 14 illustrates a fourth embodiment of the pump designated generally by the reference number 20C. The pump 20C is illustrated in FIG. 14 in a fully actuated condition as schematically represented by the arrow 170. The pump 20C has a structure which is substantially the same as the structure of the pump 20 described above with reference to FIG. 1 except that the liner 43 of the pump 20 illustrated in FIG. 1 has been omitted. Further, a dual port discharge path system is provided for establishing communication with the insert nozzle 103B in the pump 20C. In particular, the pump 20C has an actuator button 81C which defines two conduits or passages 104C which each extend between the discharge cavity 102C and the insert nozzle 103C. This is in contrast with the first embodiment of the pump 20 illustrated in FIG. 1 where only one passage 104 extends between the insert nozzle 103 and the discharge cavity 102.

The remaining structure of the pump 20C is substantially the same as in the first embodiment of the pump 20 described above with reference to FIG. 1, and the pump 20C operates in substantially the same manner as the pump 20.

Figure 15:
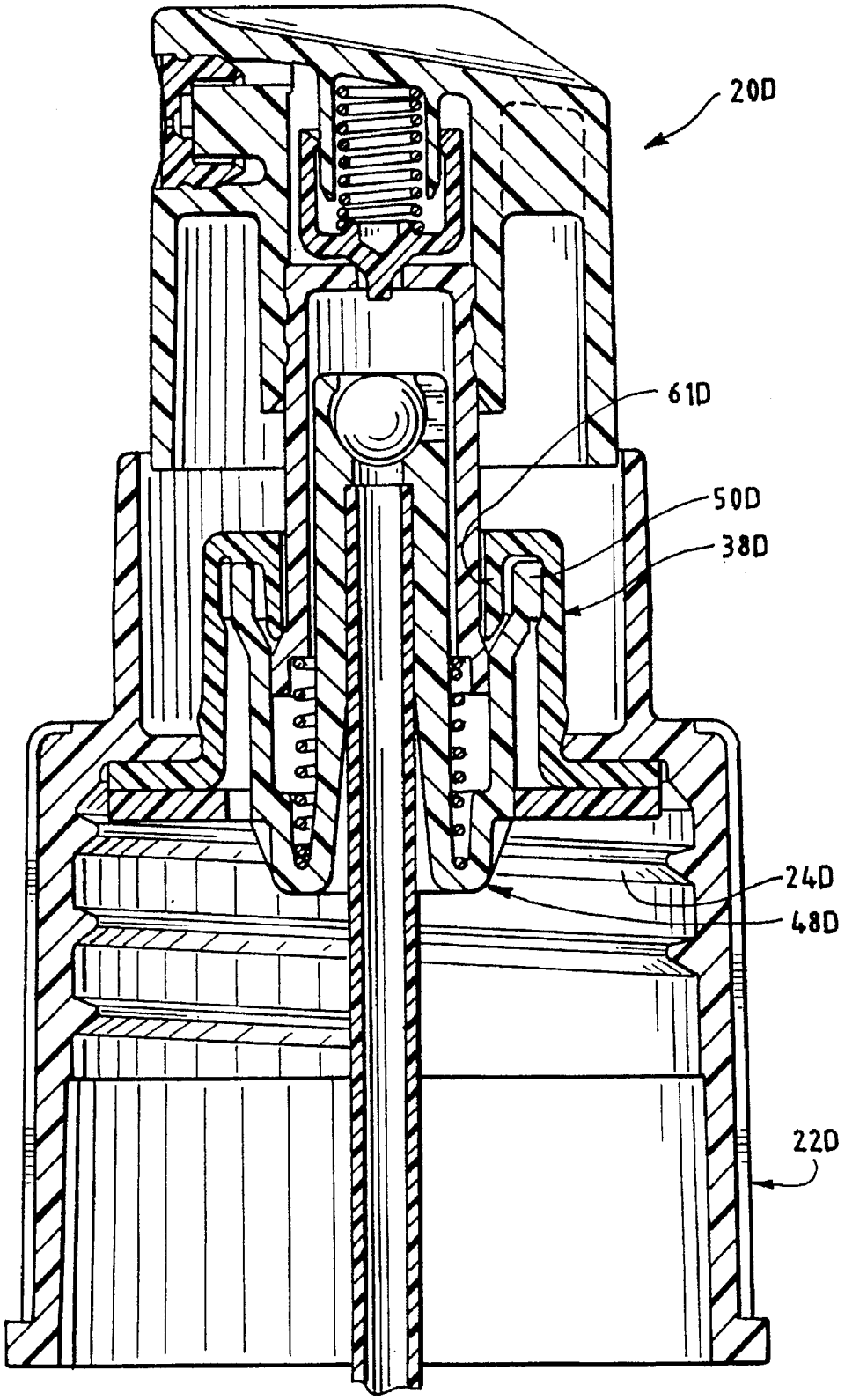
FIG. 15 is a view similar to FIG. 1, but FIG. 15 illustrates a fifth embodiment.

A fifth embodiment of a pump in accordance with the principles of the present invention is illustrated in FIG. 15 and is designated generally therein by the reference number 20D. The pump 20D illustrated in FIG. 15 has a greater height or greater vertical profile than the pump 20 illustrated in FIG. 1. This is because the pump 20D has a pump body 48D that is positioned relatively higher in the closure or cap 22D. The bottom of the pump body 48D projects down below only the first thread 24D in the cap 22D. In contrast, in the pump 20 illustrated in FIG. 1, the bottom of the pump body 48 projects completely below the lowest part of the threads.

In order to accommodate the higher mounting of the pump body 48D in the pump 20D, the pump 20D includes a modified turret 38D. In particular, the turret 38D has a single, inner, annular wall 61D, and the turret 38D does not include additional inner walls, such as the shoulder 62 and wall 63 of the turret 38 in the first embodiment of the pump 20 illustrated in FIG. 1.

Additionally, the pump body 48D in the pump 20D illustrated in FIG. 15 includes an upper, outer, peripheral rim 50D which is located closer to the bottom of the pump body 48D. In contrast, in the pump 20 illustrated in FIG. 1, the pump body rim 50 is located at a greater vertical distance away from the bottom of the pump body 48.

With respect to the other components of the pump 20D, the component structures are substantially the same as in the first embodiment of the pump 20 described above with reference to FIG. 1. The pump 20D operates in substantially the same manner as the pump 20.

Figure 16:
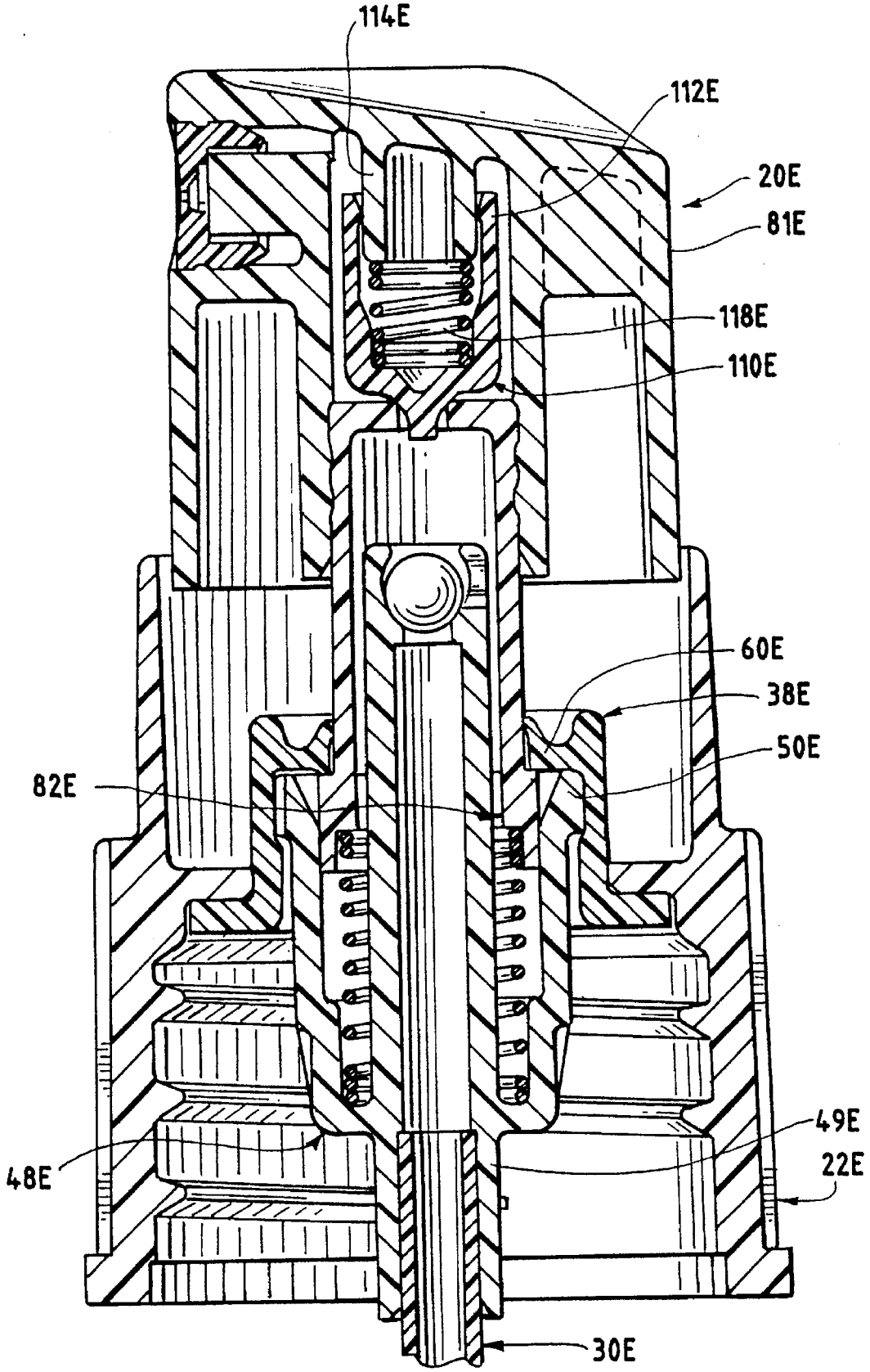
FIG. 16 is a view similar to FIG. 1, but FIG. 16 illustrates a sixth embodiment.

A sixth embodiment of the pump is illustrated in FIG. 16 wherein the pump is designated generally by the reference number 20E. The pump 20E has a height greater than that of the pump 20 illustrated in FIG. 1. In particular, the button 81E, in the unactuated position, is located at a higher elevation relative to the closure or cap 22E compared to the elevation of the button 81 on the cap 22 in the pump 20 illustrated in FIG. 1.

The greater height of the pump 20E results primarily from a modified pump body 48E, a modified turret 38E, and a slightly modified cap 22E. The outer annular wall of a pump body 48E has a configuration which is simpler than the configuration of the outer annular wall of the pump body 48 in the first embodiment of the pump 20 illustrated in FIG. 1.

Further, the turret 38E in the pump 20E illustrated in FIG. 16 does not have a downwardly extending, inner, annular wall adjacent the pump body upper rim 50E. That is, the annular walls 61 and 63 in the pump 20 illustrated in FIG. 1 have been omitted from the turret 38E of the pump 20E illustrated in FIG. 16. Rather, the turret 38E of the pump 20E includes an inwardly extending, generally annular, top wall 60E which defines an opening through which a piston 82E projects.

The piston 82E has an enlarged, lower end which engages the inner edge of the turret top wall 60E, and this determines the top of the actuation stroke, and hence, the overall height of the pump 20E. In the unactuated, rest position, the pump piston 82E is disposed higher in the pump body 48E compared to the height of the piston 82 in the pump body 48 in the first embodiment of the pump 20 illustrated in FIG. 1. Thus, the pump 20E can have a greater height without increasing the length of the piston 82E per se or the length of the actuation button 81 per se.

The pump 20E also has a modified valve member assembly within the actuation button 81E. In particular, a valve member 110E is provided with a longer skirt or sleeve 112E for engaging a downwardly projecting post 114E in the button 81E. A biasing spring 118E is disposed between the end of the post 114E and the lower end of the valve member 110E to bias the valve member 110E toward the piston 82E. Thus, the spring 118E is not disposed within the hollow post 114E, and this is different than in the first embodiment of the pump 20 wherein the biasing spring 118 is disposed inside of the post 114 as illustrated in FIG. 1.

The pump 20E also employs a modified design for the location of the upper end of a dip tube 30E. The upper end of the dip tube 30E is located near the bottom of the pump body 48E and is disposed within a hollow post or sleeve 49E which extends downwardly around the upper, distal end of the dip tube 30E. This is in contrast with the higher location of the upper end of the dip tube 30 in the first embodiment of the pump 20 illustrated in FIG. 1.

Finally, the pump 20E does not have a gasket or liner, such as the gasket or liner 43 employed in the pump 20 illustrated in FIG. 1. However, such a gasket or liner may be employed if desired. Alternatively, the gasket or liner may be integrally included with the lower portion of the turret 38E or may be provided as a unitary part of the turret 38E.

The remaining components of the pump 20E are substantially the same as the corresponding components in the first embodiment of the pump 20 described above with reference to FIG. 1. The pump 20E operates in substantially the same manner as the pump 20.

Figure 17:
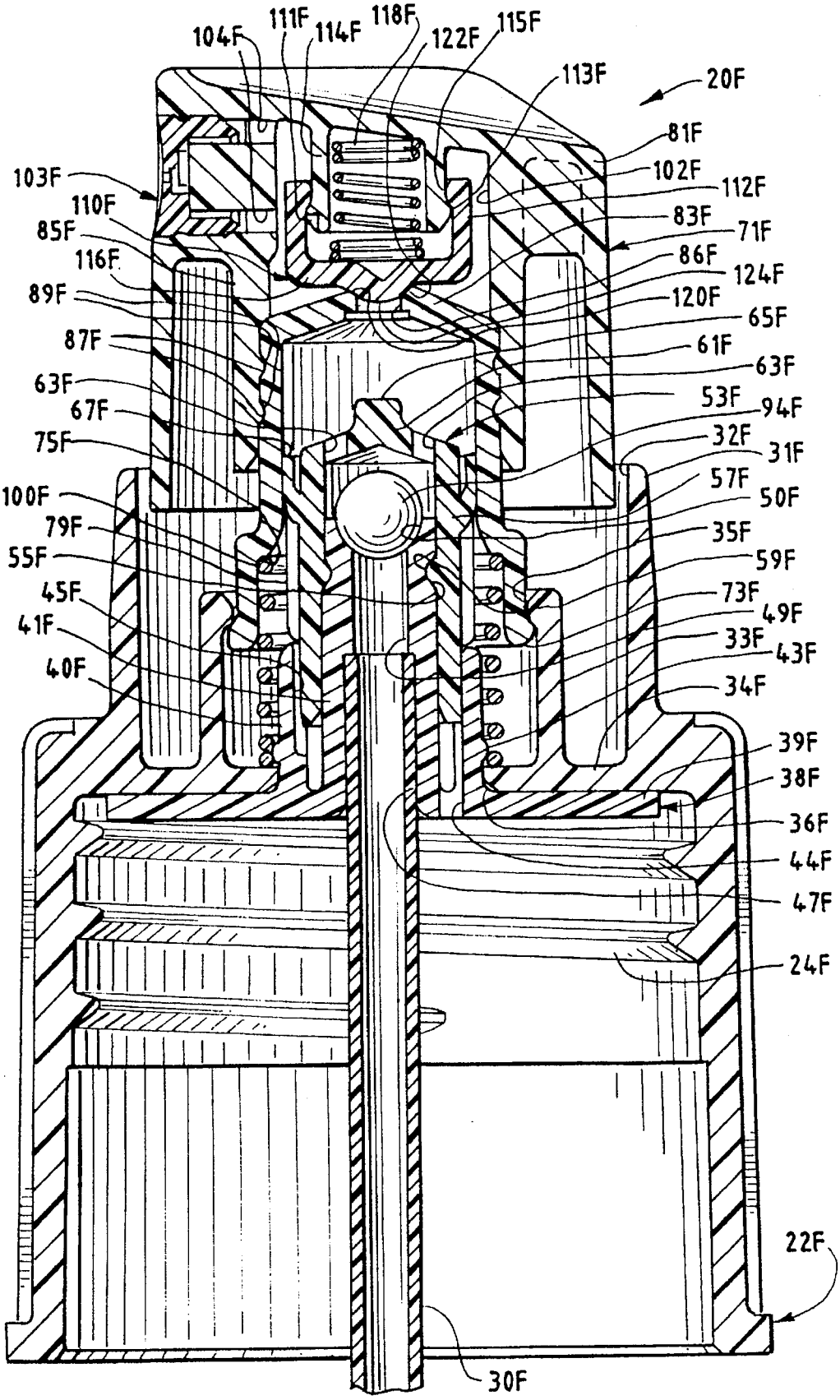
FIG. 17 is a view similar to FIG. 1, but FIG. 17 illustrates a seventh embodiment.
Figure 18:
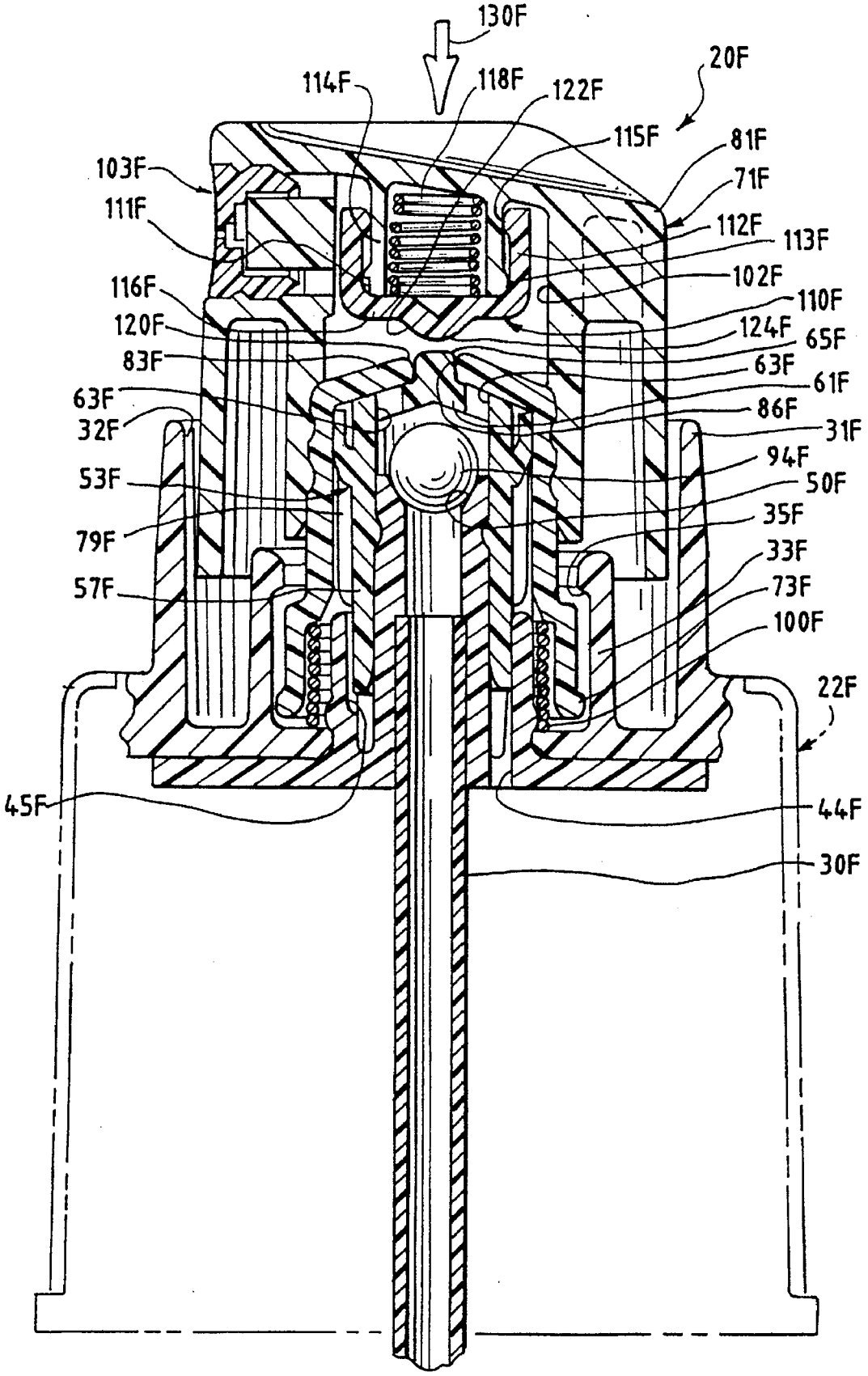
FIG. 18 is a view similar to FIG. 4, but FIG. 18 shows the seventh embodiment in a moved position.

FIGS. 17 and 18 illustrate a seventh, and preferred, embodiment of the pump which is designated generally by the reference number 20F. The pump 20F is mounted within a conventional closure, cup, or cap 22F which includes suitable means, such as threads 24F, for attaching the cap 22F, along with the pump 20F mounted therein, to the open top of a conventional container.

The liquid in the container is drawn up into the pump 20F through a conventional suction tube or dip tube 30F which is connected by suitable conventional means to the bottom of pump 20F.

The cap 22F has a generally cylindrical, outer, annular wall 31F defining an interior opening 32F above, and separated from, the threads 24F by an inwardly projecting, annular flange 34F.

The cap 22F has a generally cylindrical, inner, annular wall 33F spaced inwardly of the outer wall 31F. The inner wall 33F extends upwardly from the flange 34F. The upper end of the inner wall 33F includes an inwardly directed flange or bead 35F.

At the base of the inner wall 33F, the flange 34F extends radially inwardly and defines an opening 36F for receiving a portion of the pump 20F. The pump 20F includes a base portion, turret, or body 38F. The turret or body 38F has an annular flange 39F disposed beneath the cap flange 34F. The pump turret 38F also includes an outer, annular wall 40F extending upwardly from the turret flange 39F and has an inner, annular wall 41F extending upwardly from the turret flange 39F. The turret flange opening 36F is large enough to receive the pump turret outer wall 40F.

In the preferred embodiment illustrated, the pump turret outer wall 40F defines an exterior, circumferential bead 43F. The wall 41F and/or the turret flange 39F are sufficiently resilient to temporarily deform so as to accommodate insertion of the pump turret 38F through the cap opening 36F until the bead 43F has been located above the turret flange 39F. This establishes a snap-fit engagement which maintains the assembly together.

The turret flange 39F defines a vent aperture 44F. The vent aperture 44F establishes communication between the container interior and the space between the pump turret outer wall 40F and inner wall 41F. The pump turret outer wall 40F defines a vertical groove 45F which extends along the inside surface of the wall 40F partway down from the top of the wail. The atmosphere within the container can thus communicate—through the vent aperture 44F, through the annular space between the walls 40F and 41F, and through the groove 45F—with the interior space between the pump turret outer wall 40F and the cap inner wall 33F.

The pump turret inner annular wall 41F defines a lower bore 47F for receiving the upper end of the dip tube 30F. The wall 41F defines a somewhat smaller bore 49F above the upper end of the dip tube 30F. The bore 49F terminates in a frustoconical valve seat 50F on which is disposed a non-return ball or check valve ball 94F.

A stationary piston 53F is mounted to the pump body inner wall 41F. To this end, the exterior surface of the turret inner wall 41F defines a horizontal, annular groove 55F, and the piston 53F has a generally cylindrical skirt 57F defining a horizontal bead 59F for matingly engaging the groove 55F. Preferably, the turret inner wall 41F and/or the stationary piston skirt 57F are sufficiently resilient to accommodate initial assembly of the two components wherein the piston skirt 57F can be slid onto the inner wall 41F until the snap-fit engagement is established.

The stationary piston 53F has an end wall or cross wall 61F at the top of the skirt 57F. The end wall 61F retains the ball 94F. The end wall 61F defines a pair of apertures 63F. The outside, upper surface of the end wall 61F defines an upwardly projecting post 65F.

A flexible sealing flange or skirt 67F is provided on the outside of the stationary piston skirt 57F. The sealing skirt 67F is adapted to sealingly engage the inside surface of an inner cylindrical skirt 69F of a plunger 71F.

The lower end of the plunger skirt 69F defines an outwardly extending flange or bead 73F. The plunger skirt 69F also defines an internal shoulder 75F for receiving the upper end of a compression spring 100F. The lower end of the compression spring 100F rests against the upper surface of the cap flange 34F. This normally biases the plunger 71F upwardly to a fully elevated, rest position as shown in FIG. 17.

In the fully elevated position, the plunger skirt bead 73F engages the cap outer wall bead 35F, and this prevents any further upward movement of the plunger 71F.

Additionally, when the plunger 71F is in the fully elevated, unactuated rest position illustrated in FIG. 17, there is a gas-tight seal between the cap wall bead 35F and the plunger skirt bead 73F. This prevents communication between ambient atmosphere in the space under the plunger skirt which is in communication with the container interior (through the above-described vent groove 45F and vent aperture 44F). However, when the plunger is in a lowered position (as shown in FIG. 18), the plunger skirt bead 73F is adjacent, but not sealingly engaged with, the inner cylindrical surface of the cap inner wall 33F. Thus, when the plunger is in a lowered position, the ambient atmosphere can flow into the container interior as may be required to maintain atmospheric pressure within the container as the container contents are discharged. However, when the plunger 71F is in the fully elevated position as shown in FIG. 17, the sealing engagement between the plunger skirt bead 73F and the cap inner wall bead 35F prevents evaporation of the container contents or leakage of the container contents if the container is inverted or tilted.

In the preferred embodiment illustrated in FIG. 17, the stationary piston 53F includes a plurality of circumferentially spaced stabilizing ribs 79F. This helps stabilize and guide the plunger as it moves downwardly and back upwardly on the stationary piston. 53F.

Preferably, the stationary piston upper end wall 61F has a domed configuration that is convex upwardly. Similarly, the plunger 71F has an intermediate cross wall 83F which also has a domed shape that is upwardly convex. The domed configuration of the piston upper end wall 61F and of the plunger cross wall 83F functions to reduce flow losses during the dispensing of the container contents when the pump is operated as described hereinafter.

The plunger 71F includes an actuating button 81F. The actuating button 81F has an inner cylindrical wall 85F which receives upper end of the plunger skirt 69F. In the preferred embodiment illustrated, the plunger skirt 69F defines a pair of annular grooves 87F, and the button annular wall 85F defines a pair mating, annular beads 89F. The plunger inner skirt 69F and/or the button wall 85F are sufficiently resilient to accommodate assembly wherein the beads 89F snap-fit into the grooves 87F.

The intermediate cross wall 83F of the plunger 71F defines a discharge orifice 86F. The discharge orifice 86F is part of a discharge passage defined in the plunger 71F, and the discharge passage extends upwardly from the discharge orifice 86F to the exterior of the button 81F.

The discharge passage within the actuating button 81F includes an enlarged cavity 102F downstream of the discharge orifice 86F (i.e., above the orifice 86F as viewed in FIG. 17). The discharge cavity 102F communicates with a conventional spray insert nozzle 103F through suitable passages 104F. Liquid passing through the insert nozzle 103F under pressure exits the nozzle as a fine mist spray. The insert nozzle 103F may be of any suitable conventional or special design. The detailed design and operation of the insert nozzle 103F form no part of the present invention.

A valve member 110F is disposed within the discharge cavity 102F. In the preferred form illustrated, the valve member 110F has an annular sleeve 112F which is slidably and sealingly engaged with a hollow post 114F that projects downwardly from the top of the button 81F inside the discharge cavity 102F. A bead or flange 115F is provided on the inside of the sleeve 112F to effect the seal against the post 114F. The hollow post 114F has an annular bead 113F for retaining the valve member 110F during assembly. The post 114F and the valve member 110F are sufficiently resilient to accommodate movement of the valve member bead 115F past the post bead 113F during assembly.

The hollow post 114F defines a vent groove 111F on the exterior surface of the post. This reduces the amount of air that is trapped and compressed inside the valve member 110F during assembly.

The valve member 110F includes a cross wall 116F at the bottom of the sleeve 112F. A helical compression spring 118F is disposed within the hollow post 114F, and the upper end of the spring 118F bears against the top of the button 81F while the lower end of the spring 118F bears against the valve member cross wall 116F so as to bias the valve member 110F upstream toward the discharge orifice 86F (i.e., downwardly as viewed in FIG. 17).

The valve member 110F, in the rest position illustrated in FIG. 17, occludes the discharge orifice 86F. To this end, the intermediate cross wall 83F in the plunger 71F defines a valve seat 120F around the periphery of the downstream (upper) edge of the discharge orifice 86F. Further, the valve member 110F defines a frustoconical sealing surface 122F for sealingly engaging the valve seat 120F.

The valve member 110F includes an engaging bump or post 124F projecting downwardly from the frustoconical sealing surface 122F. When the valve member 110F is in the fully closed position as illustrated in FIG. 17, the engaging post 124F projects into the discharge orifice 86F.

The operation of the pump 20 will next be described with reference to FIGS. 17 and 18. The pump components initially have the positions as illustrated in FIG. 17, and it is assumed that liquid fills the space between the closed seat 50F of the seated check valve ball 94F in the stationary piston 53F and the plunger intermediate end wall 83F. This space is defined as the pump chamber. The priming process by which the pump chamber initially becomes filled with liquid is described in detail hereinafter.

When an initial force is applied to the plunger 71F to move the plunger downwardly, the downward movement of the plunger is indicated by arrow 130F in FIG. 18. Because the check valve ball 94F is sealed closed on the seat 50F, the downward movement of the plunger compresses the liquid in the pump chamber and also compressed any air that may be trapped therein. The downward movement of the plunger 71F also causes the return spring 100F to compress.

Continued downward movement of the plunger 71F causes the pressure within the pump chamber to build up sufficiently to force the valve member 110F upwardly away from the valve seat 120F around the discharge orifice 86F when the force of the valve spring 118F is overcome. Initially, when the valve member 110F is in the fully closed position, as illustrated in FIG. 17, only the portion of the valve member 110F that projects inwardly (downwardly) from the valve seat 120F is exposed to the increasing pressure in the pump chamber. The area of the valve member 110F exposed to the valve chamber pressure when the valve member is in the closed position may be characterized as a "first pressurizable area" or "first area," and it is a relatively small area. Accordingly, a substantial pressure must be built up within the pump chamber in order to initially move the valve member 110F against the spring 118F and upstream away from the valve seat 120F. However, as soon as the valve member 110F has been lifted just slightly off of the valve seat 120F, the rest of the exterior surface of the valve member 110F is exposed to the chamber pressure as the pressurized liquid flows through the discharge orifice 86F. This occurs as soon as the valve member 110F is lifted an infinitesimal amount.

The valve member 110F may be characterized as having a "second pressurizable area" which is subjected to the chamber pressure when the valve member 110F is moved away from the valve seat 120F. The pressure force imposed on the valve member 110F by the chamber pressure when the valve member is spaced away from the valve seat 120F is greater than the pressure force imposed on the valve member by the chamber pressure when the valve member is closed.

In the preferred embodiment illustrated in FIGS. 17 and 18, the second pressurizable area of the valve member 110F includes the first pressurizable area which is exposed to the chamber pressure when the valve member is in the closed position. Both the first pressurizable area and second pressurizable area of the valve member include curved or multiple surfaces subjected to pressure which imposes pressure-generated forces in more than one direction. However, as the valve member 110F is lifted off of the seat 129F, the sum of the pressure-generated forces acting on the valve member in the direction to urge the valve member 110F away from the valve seat 120F exceeds the sum of the pressure-generated forces acting on the valve member to urge the valve member toward the valve seat 120F.

Nevertheless, until a predetermined pressure is established in the valve chamber by depressing the plunger 71F, the net pressure-generated force acting to urge the valve member 110F open is opposed and exceeded by the biasing force of the spring 118F. When the net pressure force acting to urge the valve member 110F away from the valve seat 120F exceeds the force of the spring 118F, the valve member 110F begins to open. Then the second pressurizable area of the valve member 110F is subjected to a substantially instantaneously increased net pressure force acting in a direction to force the valve member 110F further away from the seat 120F, and this instantaneously applied, increased, net pressure force drives the valve member 110F very rapidly upwardly to the full open position illustrated in FIG. 18 wherein the spring 118F is in a condition of maximum compression and the valve member cross wall 116F engages the distal end of the post 114F.

When the valve member 110F moves quickly to the fully open position as illustrated in FIG. 18, communication is established between the pressure chamber and the discharge passage which includes the cavity 102F. Because the valve member 110F moves quickly to its fully open position in the discharge cavity 102F, the maximum volume of the discharge passage is substantially instantaneously placed in communication with the pressure chamber (which is the volume between the closed seat 50F of the check valve ball 94F and the orifice 86F). The pressurized liquid from the pressure chamber can then flow rapidly through the fully opened orifice 86F, past the valve seat 120F, and through the maximum volume of the discharge passage which includes the button cavity 102F and nozzle 103F.

Because the large surface area at the upstream (lower) distal end of the open valve member 110F is subjected to the fluid pressure, the valve member 110F is held by the pressure at the full open position (FIG. 18). This is in contrast with certain conventional designs wherein a valve must be held away from a valve seat by the friction loss forces or velocity head forces of the fluid flowing past the valve member. The reduced resistance to liquid flow past the fully opened valve member 110F results in a relatively high discharge rate of liquid from the pressure chamber through the button discharge passage. This provides the desired fine mist spray and permits the plunger 71F to move rapidly to the bottom of the stroke.

When the pump 20F is actuated, the operator senses that the pump seems to have an initial, momentary resistance to plunger actuation which is followed by a relatively low resistance. The initial, higher force supplied by the operator causes the operator's finger to continue moving—with the initially applied high force and at a high rate of speed—against the actuator until the plunger reaches the end of the compression stroke. The compression stroke is sufficiently short, and the initial resistance is sufficiently high, so that the operator normally cannot, even if he tries, release his finger pressure fast enough to effect only a partial compression stroke or to effect the compression stroke at a slow rate. Further, owing to the operator's finger momentum, the stroke is completed at a sufficiently high rate of speed to provide at least the minimum liquid discharge flow rate that is necessary to produce the desired volume of spray and the desired degree of atomization.

The relationship among the valve member first pressurizable area, the second pressurizable area, and the associated biasing spring 118F may be characterized as a "releasable holding means" for holding the valve member in the closed position when the chamber pressure is less than the predetermined pressure and for permitting the chamber pressure to urge the valve member to an open position with a substantially instantaneously increased net pressure force on the valve member when the chamber pressure is at least equal to the predetermined pressure.

At the bottom of the stroke, the plunger cross wall 83F (in which the discharge orifice 86F is defined) engages the distal end cross wall 61F of the stationary piston 53F. At this point, the spring 100F is substantially fully compressed. Preferably, this results in a minimum of "dead" space or volume. Thus, there is only a very small volume remaining in the pressure chamber above the closed check valve ball seat 50F at the bottom of the compression stroke that can be occupied by residual liquid.

It will be appreciated that the non-return ball 94F is normally held by gravity in a sealing position on the valve seat 50F so as to prevent the compressed liquid from being forced back down into the dip tube 30F. During the pressurization of the pump chamber by the plunger 71F, the increased pressure serves to additionally hold the ball 94F in sealing engagement on the valve seat 50F.

As the pressurized liquid is discharged out of the insert nozzle 103F from the pump 20F, the pressure within the discharge passage, including the discharge cavity 102F, decreases. The net pressure force on the valve member 110F which holds the valve member 110F away from the valve seat 120F thus decreases. When the net pressure force acting upwardly on the valve member 110F becomes less than the force of the spring 118F, the valve member 110F is forced downwardly by the spring 118F toward the valve seat 120F. The lower, distal end of the valve member protrusion 124F then engages the top of the stationary piston post 65F. This prevents the valve member 110F from immediately sealingly engaging the valve seat 120F and occluding the discharge orifice 86F. This feature is employed in initially priming the pump with liquid and discharging the air from within the pump chamber as described in detail hereinafter.

Generally, when the operator of the pump realizes that the further downward movement of the pump plunger 71F is prevented, the operator terminates the application of force through the operator's finger. The return spring 100F is then able to force the actuator plunger 71F upwardly toward the fully elevated, rest position (FIG. 17).

As the plunger 71F moves upwardly under the influence of the return spring 100F, the plunger cross wall 83F moves upwardly away from the stationary piston post 65F. This permits the valve seat 120F to be engaged by the valve member 110F which is biased downwardly by the spring 118F. The valve member 110F then remains held by the biasing spring 118F in sealing engagement against the valve seat 120F as the plunger returns to the fully elevated position (FIG. 17).

It will be appreciated that as the plunger 71F moves upwardly with the discharge orifice 86F sealed closed by the valve member 110F, the volume of the pressure chamber defined below the cross wall 83F increases. This results in a decrease in the internal pressure within the pressure chamber.

The liquid in the container is under atmospheric pressure. The difference between the atmospheric pressure on the liquid in the container and the reduced pressure under the plunger cross wall 83F around the non-return ball 94F defines a pressure differential. This imposes a lifting force on the liquid which drives the liquid up the dip tube 30F and lifts the check valve ball 94F. The liquid can then flow through valve seat 50F and into the pump chamber between the plunger cross wall 83F and piston valve seat 50F.

Atmospheric pressure is maintained on the liquid within the container through the previously described venting system defined by the passages 44F, 45F, and the clearance around the plunger skirt bead 73F (when the plunger 71F is depressed at least slightly). It will be appreciated that so long as the plunger 71F is below the fully elevated, rest position illustrated in FIG. 17, there is an annular clearance or space between the exterior of the plunger skirt bead 73F and the interior surface of the cap inner wall 33F. This space accommodates the vent flow of air through the vent system into the container.

When the plunger 71F returns to the fully elevated position as illustrated in FIG. 17, the plunger bead 73F sealingly engages the bead 35F at the top of the cap inner wall 33F. This prevents leakage of liquid out of the pump if the unactuated pump is inadvertently tipped over or held in a non-upright position.

When the plunger 71F returns to the fully elevated, rest position illustrated in FIG. 17, the upward movement of the plunger is terminated by the above-described engagement between the plunger bead 73F and the cap bead 35F. This prevents further upward movement of the plunger 71F. When the upward movement of the plunger 71F is thus terminated, further expansion of pressure chamber under the plunger cross wall 83F ceases. Thus, the flow of the liquid from the container up the dip tube 30F into the chamber terminates when the atmospheric pressure within the container is balanced by the sum of the pressure within the chamber and the static head of the liquid in the dip tube above the level of the liquid in the container.

When a new pump is initially assembled on a container of liquid and provided to a user, the pump chamber typically contains only air. The chamber must be primed with liquid from the container. This requires removal of much of the air in the chamber and replacement of that air with liquid from the container. This can be accomplished by depressing and then releasing the plunger 71F a number of times. When the plunger 71F is fully depressed, the air in the chamber is compressed. Because air is so highly compressible, the initial increase in pressure within the chamber may not be sufficient to overcome the biasing force of the spring 118F which holds the valve member 110F closed. However, when the plunger 71F is fully depressed, the distal end of the valve member protrusion 124F engages the post 65F on the cross wall 61F of the stationary piston 53F, and this causes the valve member 110F to be held away from the valve seat 120F. This opens the discharge orifice 86F and permits some of the slightly pressurized air to discharge through the insert nozzle 103F.

When the plunger 71F is next released, it is returned to the fully elevated position by the main spring 100F. This increases the volume of the chamber and lowers the pressure so that liquid from the container is forced by the pressure differential part way up the dip tube 30. When priming the pump 20F, the operator subjects the plunger 71F to a number of such depression and release cycles. With each cycle more air is discharged from the chamber, and more liquid flows up the dip tube and eventually into the chamber. When sufficient liquid is present in the chamber, the subsequent actuations result in a discharge of the liquid as an atomized spray.

It will be appreciated that the novel structure of the pump and valve system permits the pump to be actuated with a relatively short stroke. This makes it extremely difficult for the user to terminate a compression stroke before the plunger 71F reaches the bottom of the stroke. The initial force required to begin to move the plunger down is sufficiently great compared with the force required when the air and/or liquid begins discharging from the nozzle so that the user cannot easily terminate or slow down the stroke before the bottom of the stroke is reached. Thus, the full stroke quantity of fluid will be discharged from the pump at a flow rate that will be sufficient to provide the desired fine mist atomization.

Because the stroke length is relatively short, the overall height of the pump can be reduced, and shorter pump components can be employed.

If desired, larger ports or dual ports may be utilized in the plunger button 81F. Further, the pump 20F and cap 22F may be combined as a unitary structure.

Figure 19:
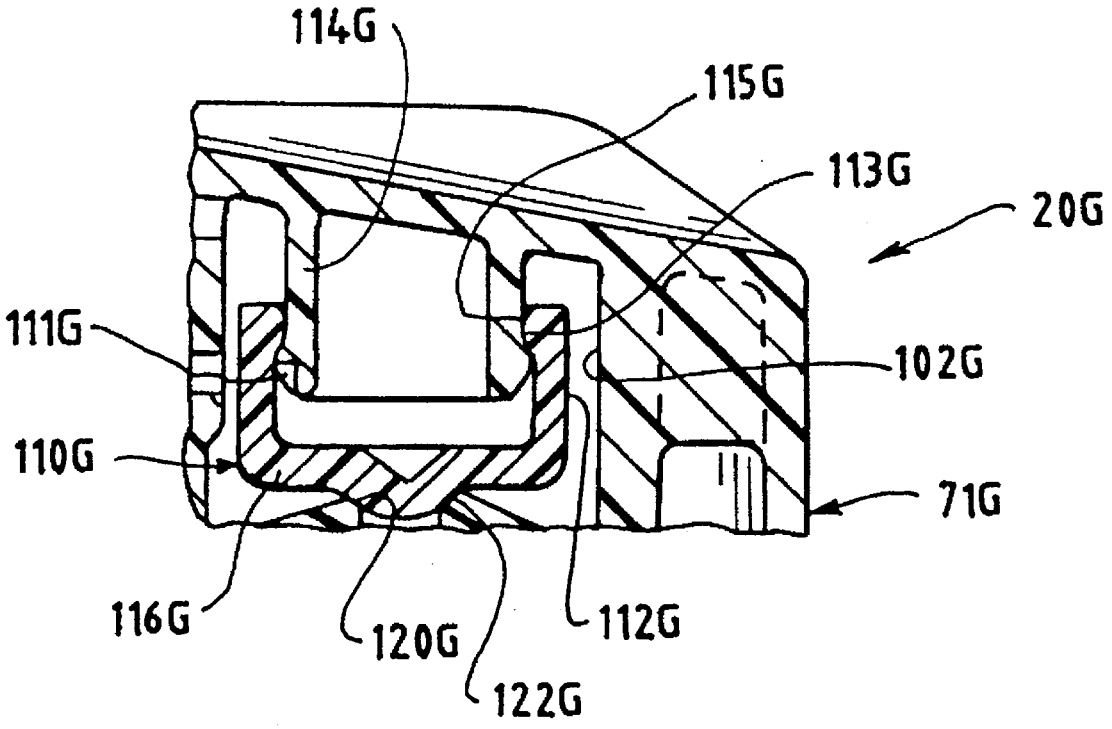
FIG. 19 is a view similar to FIG. 17, but FIG. 19 illustrates an eighth embodiment.

The means for biasing the valve member 110F toward the discharge orifice 86F (which biasing means is part of the releasable holding means) may include any suitable biasing system. FIG. 19 illustrates a modification of the embodiment illustrated in FIGS. 17 and 18 wherein the valve member biasing spring 118F (FIG. 17) is eliminated and replaced by a different biasing system in the modified pump 20G. In particular, FIG. 19 illustrates a valve member 110G mounted on a hollow post 114G, but there is no helical coil compression spring disposed within the post 114G.

The structure of the pump 20G is otherwise identical with the pump structure of the embodiment illustrated in FIGS. 17 and 18. In particular, the valve member 110G has an annular sleeve 112G sealingly engaged with the hollow post 114G that projects downwardly from the top of the button of the plunger 71G. The valve member 110G is slidable on the post 114G within a discharge cavity 102G which communicates with a conventional spray insert nozzle through suitable passages.

A bead or flange 115G is provided on the inside of the sleeve 112G to effect a seal against the post 114G. The hollow post 114G has an annular bead 113G for retaining the valve member 110G during assembly. The post 114G and the valve member 110G are sufficiently resilient to accommodate movement of the valve member bead 115G past the post bead 113G during assembly.

The hollow post 114G may include a vent groove 111G on the exterior surface of the post. This reduces the amount of air that is trapped and compressed inside the valve member 110G during assembly.

The valve member 110G includes a cross wall 116G at the bottom of the sleeve 112G. In the rest position illustrated in FIG. 19, the valve member 110G defines a frustoconical sealing surface 122G for sealingly engaging the valve seat 120G.

Except for the absence of a helical coil compression spring within the post 114G, the structure of the pump 20G illustrated in FIG. 19 is identical with the structure of the pump 20F illustrated in FIGS. 17 and 18.

In the alternate embodiment illustrated in FIG. 19, the air trapped within the post 114G and within the valve member 110G functions as a spring for maintaining the valve member 110G closed and for returning the valve member after the dispensing of product from the pump chamber.

The volume of air within the valve member 110G and post 114G may be adjusted to provide the desired spring action. The spring action can be designed to be overcome at a selected pressure generated inside the pump dispensing chamber.

The vent groove 111G may be eliminated if desired. In any event, various systems for adjusting the amount of air trapped above the valve member 110G may be provided. For example, an air bleed slot could be provided on the post 114G. This could be similar to, but longer than, the vent groove 111G illustrated in FIG. 19. The length of the slot may be selected for adjusting the air volume inside the valve member chamber. As the valve member 110G is assembled onto the post 114G, air is allowed to bleed out of such a slot for a selected distance. After the valve member 110G has been fully assembled onto the post 114G, the valve member would always remain in a sealed condition thereafter in both the static, closed position (illustrated) and in the open, dispensing position.

Alternatively, the air volume inside of the valve member 110G could be changed by altering the physical size of either or both the valve member 110G and post 114G. This may be done by changing the diameter and/or length of either or both the valve member 110G and post 114G.

The volume of air acting against the valve member 110G could also be changed by adding an object (either solid or liquid) within the valve member 110G or post 114G. A post or similar structure could be added inside either or both the valve member 110G and post 114G. Even a non-attached, loose object, or quantity of liquid, could be disposed within the two parts.

The system for biasing the valve member 110G with compressed air instead of a helical compression spring, or other specific spring structure, may provide some advantages. The elimination of a separate spring part is, of course, a manufacturing and cost advantage.

In addition, because air volume tolerances may be easier to control than spring structure tolerances, it may be possible to provide a more consistent actuating force requirement for pump operation. For example, if a separate spring structure is employed (as in the embodiments illustrated in FIGS. 1–18), then the valve member opens when the spring force is overcome by the pump dispensing chamber pressure. The variation in pressure to open the valve may be greater when a separate spring structure is employed.

Consider the following example. If the area of the valve member exposed to the pump dispensing chamber pressure when closed is 0.005 square inch, then the valve member may open at a pressure of about 80 pounds per square inch when a spring having a spring force of about 6.8 ounces (static height load) is employed and may open at 110 pounds per square inch when a spring having a spring force of 9.3 ounces is employed. Thus, a spring tolerance range of 2.5 ounces (9.3–6.8) results in a required dispensing chamber pressure variance of 30 pounds per square inch (110–80), and this difference will result in a variation of actuation force which could be felt by the consumer. The use of an air biasing system to replace a spring structure may result in less variation.

It will also be appreciated that the valve member biasing springs employed in the embodiments illustrated in FIGS. 1–16 may also be eliminated and replaced with an air compression spring system or with some other spring structure.

It is contemplated that most of the components of a pump incorporating the present invention can be preferably fabricated from thermoplastic materials, such as polyethylene, polypropylene, and the like. However, the piston return spring and the valve member biasing spring (e.g., spring 110 and spring 118, respectively, in FIG. 1) would preferably be made from a suitable spring steel.

The present invention can be incorporated in pumps having a variety of pump heights and external configurations. The internal components and structures are readily, and preferably, designed to provide a minimum final volume in the compression chamber at the end of the compression stroke so as to effect an efficient pumping and priming action.

A pump incorporating the present invention minimizes, if not eliminates, the likelihood that the pump will be actuated with less than a complete compression stroke and at a stroke speed less than is needed to provide the desired spray characteristics.

Further, a pump incorporating the improved design in accordance with the present invention can perform consistently with respect to discharge particle size and with respect to the required actuation force as well as with respect to the quantity of discharged product per full stroke actuation.

The invention can be readily incorporated in a pump wherein the components are relatively easy to manufacture with high production quality, and wherein properly designed and assembled pumps will exhibit consistent operating parameters unit-to-unit with high reliability.

It will be readily apparent from the foregoing detailed description of the invention and from the illustrations thereof that numerous variations and modifications may be effected without departing from the true spirit and scope of the novel concepts or principles of this invention.

What is claimed is:

1. A discharge valve system in combination with a finger-operable pump that includes a piston and a hollow, actuating plunger disposed for sliding movement on said piston to define a pressurizing chamber, said plunger defining a discharge passage establishing communication between ambient atmosphere and said chamber, said discharge valve system comprising:

a valve seat defined by said plunger in said discharge passage;

a valve member in said discharge passage movable (a) upstream to a closed position against said valve seat wherein said valve member defines a first area subjected to the chamber pressure and (b) downstream to an open position away from said valve seat wherein said valve member defines a second area subjected to the chamber pressure such that the net pressure force imposed on said valve member by said chamber pressure is greater when said valve member is open than when said valve member is closed; and a spring biasing said valve member toward said valve seat.

2. The discharge valve system in accordance with claim 1 in which said spring is one of a helical spring and air under compression.

3. The discharge valve system in accordance with claim 1 in which said second area includes said first area;

each said area includes multiple surfaces subjected to pressure which imposes pressure-generated forces in more than one direction; and the sum of pressure-generated forces acting on said valve member in the direction to urge said valve member away from said valve seat exceeds the sum of pressure-generated forces acting on said valve member to urge said valve member toward said valve seat.

4. The discharge valve system in accordance with claim 1 in which said valve member defines a sleeve slidably and sealingly engaged with a portion of said actuating plunger downstream of said valve seat; and said piston is fixed within said pump.

5. A discharge valve system in combination with a finger-operable pump that includes a piston and a hollow, actuating plunger disposed for sliding movement on said piston to define a pressurizing chamber, said plunger defining a discharge passage establishing communication between ambient atmosphere and said chamber, said discharge valve system comprising:

a valve seat defined by said plunger in said discharge passage;

a valve member in said discharge passage movable upstream to a closed position against said valve seat and downstream to an open position spaced away from said valve seat; and releasable holding means associated with said valve member for holding said valve member in said closed position when operating pressure in said chamber is less than a predetermined pressure and for permitting the operating pressure to urge said valve member away from said closed position with a substantially instantaneously increased net pressure force on said valve member when the operating pressure is at least equal to said predetermined pressure.

6. The discharge valve system in accordance with claim 5 in which said releasable holding means includes:

(a) a first area that is defined by said valve member and that is subjected to the operating pressure in said pressurizing chamber upstream of said valve seat when said valve member is in said closed position against said valve seat;

(b) a second area that is defined by said valve member and that is subjected to the operating pressure when said valve member is moved away from said closed position such that the net pressure force imposed on said valve member by said operating pressure to urge said valve member away from said closed position is greater when said valve member is away from said closed position than when said valve member is at said closed position; and (c) a spring biasing said valve member toward said valve seat.

7. The discharge valve system in accordance with claim 6 in which said spring is one of a helical spring and air under compression.

8. The discharge valve system in accordance with claim 6 in which said valve member defines a sleeve slidably and sealingly engaged with a portion of said actuating plunger downstream of said valve seat; and said piston is fixed within said pump.

9. A discharge valve system in combination with a finger-operable pump suitable for mounting on a container to dispense fluid therefrom wherein said-pump receives fluid from said container and wherein said pump includes a piston and a hollow, actuating plunger disposed for sliding movement on said piston to define a pressurizing chamber that is isolatable from said container during pressurization of said chamber, said plunger defining a discharge passage establishing communication between ambient atmosphere and said chamber, said discharge valve system comprising:

a valve seat defined by said plunger in said discharge passage;

a valve member in said discharge passage movable upstream to a closed position against said valve seat and movable downstream to an open position away from said valve seat and chamber, said valve member when closed having a first pressurizable area upstream of said seat that is effective when subjected to pressure from said chamber to urge said valve member away from said seat, said valve member when open having a second, larger pressurizable area that is effective when subjected to pressure from said chamber to continue urging said valve member away from said seat with greater force; and a spring biasing said valve member toward said valve seat.

10. The discharge valve system in accordance with claim 9 in which said spring is one of a helical spring and air under compression.

11. A finger-operable pump suitable for mounting on a container to dispense fluid therefrom, said pump comprising:

a pump body having a fluid supply inlet opening for accommodating flow of fluid from said container through said pump body;

a non-return valve located at said inlet opening to prevent return flow of fluid through said inlet opening into said container;

said pump including a fixed piston and including an actuating plunger disposed for sliding movement on said piston to define a pressurizing chamber, said plunger being operably disposed on said piston for reciprocatable, sliding movement between an elevated, unactuated, rest position and a lowered, fully actuated position, said plunger defining a discharge passage establishing communication between ambient atmosphere and said chamber, said plunger also defining a valve seat in said discharge passage;

a first spring biasing said plunger relative to said pump body toward said rest position;

a valve member in said discharge passage movable upstream to a closed position against said valve seat to occlude flow through said discharge passage and movable downstream away from said valve seat and chamber to permit flow through said discharge passage;

said valve member in said closed position presenting a first pressurizable area that is upstream of said valve seat and that upon exposure to pressure from said chamber is subjected to a first net pressure force acting to urge said valve member away from said valve seat;

said valve member having a second pressurizable area which includes said first pressurizable area and which, when said valve member is away from said valve seat and exposed to pressure from said chamber, is subjected to a greater, second net pressure force acting to urge said valve member away from said seat; and a second spring biasing said valve member relative to said plunger toward said valve seat.

12. The discharge valve-system in accordance with claim 11 in which said second spring is one of a helical spring and air under compression.

13. The pump in accordance with claim 11 in Which said second spring has a spring force selected to be overcome when the pressure in said chamber reaches a predetermined value whereby said valve member moves away from said valve seat.

14. A discharge valve system in combination with a finger-operable pump that includes an actuating plunger, a piston in a pressurizing chamber, and a discharge passage establishing communication between ambient atmosphere and said chamber, said discharge valve system comprising:

a valve seat defined by said plunger in said discharge passage;

a valve member in said discharge passage movable upstream to a closed position against said valve seat and downstream to an open position spaced away from said valve seat; and releasable holding means associated with said valve member for holding said valve member in said closed position when operating pressure in said chamber is less than a predetermined pressure and for permitting the operating pressure to urge said valve member to said open position with a substantially instantaneously increased net pressure force on said valve member when the operating pressure is at least equal to said predetermined pressure.

15. The discharge valve system in accordance with claim 14 in which said releasable holding means includes:

(a) a first area that is defined by said valve member and that is subjected to the chamber pressure upstream of said valve seat when said valve member is in said closed position;

(b) a second area that is defined by said valve member and that is subjected to the chamber pressure when said valve member is moved away from said closed position such that the net pressure force imposed on said valve member by said chamber pressure to urge said valve member away from said closed position is greater when said valve member is away from said closed position than when said valve member is at said closed position; and (c) a spring biasing said valve member toward said valve seat.

16. The discharge valve system in accordance with claim 15 in which said spring is one of a helical spring and air under compression.

17. The discharge valve system in accordance with claim 15 in which said valve member defines a sleeve slidably and sealingly engaged with a portion of said actuating plunger downstream of said valve seat.

* * * * *